US011352789B2

(12) United States Patent
Stehle

(10) Patent No.: US 11,352,789 B2
(45) Date of Patent: Jun. 7, 2022

(54) VOID FORMER

(71) Applicant: Matter Up Pty Ltd, Carnegie (AU)

(72) Inventor: John Stehle, Carnegie (AU)

(73) Assignee: MATTER UP PTY LTD, Carnegie (AU)

( * ) Notice: Subject to any disclaimer, the term of this patent is extended or adjusted under 35 U.S.C. 154(b) by 0 days.

(21) Appl. No.: 17/057,837

(22) PCT Filed: May 30, 2019

(86) PCT No.: PCT/AU2019/050545
§ 371 (c)(1),
(2) Date: Nov. 23, 2020

(87) PCT Pub. No.: WO2019/227161
PCT Pub. Date: Dec. 5, 2019

(65) Prior Publication Data

US 2021/0198890 A1 Jul. 1, 2021

(30) Foreign Application Priority Data

Jun. 1, 2018 (AU) ..... 2018901968

(51) Int. Cl.
*E04C 2/06* (2006.01)
*E04C 5/07* (2006.01)
(Continued)

(52) U.S. Cl.
CPC ..... *E04C 2/06* (2013.01); *E04C 5/07* (2013.01); *E04B 5/326* (2013.01); *E04B 5/36* (2013.01);
(Continued)

(58) Field of Classification Search
CPC ... E04C 2/06; E04C 5/07; E04C 5/168; E04C 2002/045; E04B 5/326; E04B 5/36;
(Continued)

(56) References Cited

U.S. PATENT DOCUMENTS 3,238,278 A * 3/1966 Stark ..... E04G 9/021 264/34
3,358,960 A * 12/1967 Oliver ..... E04G 9/083 249/175

(Continued)

FOREIGN PATENT DOCUMENTS

CN 101906874 A 12/2010
CN 102416657 A 4/2012
WO 2018060279 A1 4/2018

OTHER PUBLICATIONS

International Search Report and Written Opinion for corresponding International Patent Application No. PCT/AU2019/050545, dated Sep. 16, 2019.

(Continued)

*Primary Examiner* — Patrick J Maestri
(74) *Attorney, Agent, or Firm* — Westman, Champlin & Koehler, P.A.

(57) ABSTRACT

The present invention relates to methods of forming voids in concrete elements, and to a void former apparatus and system useful for this application. The void former unit comprises a first void former element comprising a first surface and a first opening in the first surface and a second void former element comprising a second surface and a second opening in the second surface, wherein the first void former element and the second void former element detachably connect to form a passage between the first opening and the second opening, and a void space between the first surface and the second surface surrounding the passage. Multiple void former units can detachably connect to form a void former system comprising a single continuous void space. While exemplified by use in concrete elements, other uses of the void former unit and void former system are envisaged.

20 Claims, 20 Drawing Sheets

(51) Int. Cl.

| | |
|---|---|
| *E04B 5/32* | (2006.01) |
| *E04B 5/36* | (2006.01) |
| *E04C 5/16* | (2006.01) |
| *E04G 23/02* | (2006.01) |

(52) U.S. Cl.
CPC ..... *E04C 5/168* (2013.01); *E04G 2023/0251* (2013.01)

(58) Field of Classification Search
CPC ..... E04B 1/046; E04G 2023/0251; E04G 15/068; B28B 23/0068
See application file for complete search history.

(56) References Cited

U.S. PATENT DOCUMENTS

| | | | | |
|---|---|---|---|---|
| 4,348,344 | A * | 9/1982 | Nobbe | E04B 1/16 119/502 |
| 4,495,744 | A | 1/1985 | Carl | |
| 5,657,595 | A * | 8/1997 | Fyfe | E02D 27/34 52/252 |
| 6,789,366 | B1 * | 9/2004 | Febra | B28B 23/0068 249/184 |
| 7,897,073 | B2 | 3/2011 | Haag et al. | |
| 2013/0036693 | A1 * | 2/2013 | Lee | E04B 5/36 52/309.1 |

OTHER PUBLICATIONS

International Preliminary Report on Patentability for corresponding Patent Application No. PCT/AU2019/050545, dated Oct. 1, 2020.

* cited by examiner

VOID FORMER

CROSS-REFERENCE TO RELATED APPLICATION(S)

This Application is a Section 371 National Stage Application of International Application No. PCT/AU2019/050545, filed May 30, 2019 and published as WO2019/227161A1 on Dec. 5, 2019, in English. The contents of each priority document are hereby incorporated by reference in their entireties.

FIELD OF THE INVENTION

The present invention relates to methods of forming voids in construction elements, and to a void former unit and system useful for this application. While the present invention will be described with respect to its use for forming voids in concrete, it is to be appreciated that the invention is not restricted to this application, and that other applications are also envisaged.

BACKGROUND TO THE INVENTION

Void formers are commonly used for forming voids or hollows within concrete elements during casting. Such voids may advantageously:

(a) reduce production costs, since less concrete is required to produce the concrete element;
(b) reduce environmental impact, since concrete production involves the use of energy and materials, and the emission of carbon dioxide;
(c) reduce overall weight of the concrete structure, which in turn reduces load-bearing within a particular design; and
(d) provide thermal and sound insulation benefits.

Void formers are also used to provide access openings or recesses in the surface of a cast concrete element. This may allow for operations to occur within the opening, including:

(a) passing utility conduits or air ventilation or water systems through passages formed in the concrete element; and
(b) connecting cast concrete elements to other construction elements including other cast concrete elements.

Void formers are typically produced from expanded polystyrene ('EPS'), since it: is low-cost and lightweight, provides sufficient compressive strength, and allows for shaping (i.e. being cut to shape). However, EPS is bulky to transport and store. While EPS is recyclable, it yields only small amounts of polystyrene for re-use on a volume basis, making it costly and unpopular to recycle. EPS also fills voids created within the concrete, hampering or preventing any construction operations within the voids.

Alternatives to EPS exist as for example as described in: U.S. Pat. Nos. 7,897,073 and 4,495,744.

U.S. Pat. No. 7,897,073 discloses void formers formed of spherical or semi-spherical plastic balls locked within metal lattices. The void formers may be incorporated into slab or precast concrete elements relatively simply. However, the modules remain bulky to transport and store; and void spaces are formed within concrete elements as multiple discrete and discontinuous spheres. The modules are not suitable for use in providing access openings in the surface of a concrete element.

U.S. Pat. No. 4,495,744 also discloses a displacement body for forming cavities in concrete elements. The displacement body comprises: a grid structure of intersecting longitudinal and transverse rods, and plastic sheets applied to both sides of the grid structure and connected to one another and the grid structure by welding and or heat shrinking. The displacement body is described as cost effective, light-weight and easily storable. However, as the displacement body is assembled though shrink wrapping and or plastic welding, it may be difficult to produce, resize and/or re-shape onsite. The disclosed displacement body does not appear suitable for use in providing access openings in the surface of a concrete element.

Despite advances in void former technology, there remains an ongoing need to overcome certain disadvantages associated with the technology, such as:

(a) being difficult and/or costly to store prior to use;
(b) making inefficient use of natural resources and materials;
(c) preventing customisation of the size and shape of a void space;
(d) providing several discrete void spaces rather than a single continuous void space;
(e) being unsuitable to provide an accessible void space in the surface of a concrete element; and
(f) failing to enable joint connections between adjacent building elements.

Disclosed embodiments of the present invention provide a void former which addresses one or more of the above-mentioned disadvantages.

When used in the specification and unless the context otherwise requires, the term 'concrete' is intended to relate not only to traditional Portland cement concretes but more broadly to any composite material involving a matrix of aggregate and a binder. Such concretes may include polymer concretes, asphalt concretes, hydraulic cement concretes generally, geopolymers, and other suitable building materials.

The reference in this specification to any prior publication, or information derived from it, or to any matter which is known, is not, and should not be taken as an acknowledgement or admission or any form of suggestion that the prior publication, or information derived from it, or known matter forms part of the common general knowledge in the field of endeavour to which this specification relates.

SUMMARY OF THE INVENTION

Throughout this specification and the claims which follow, unless the context requires otherwise, the word "comprise" and variations thereof such as "comprises" and "comprising", will be understood to include the inclusion of a stated integer or step or group of integers or steps but not the exclusion of any other integer or step or groups of integers or steps.

According to a first aspect of the invention, there is provided a void former unit suitable for forming a void in concrete elements comprising:

(a) a first void former element, the first void former element comprising a first surface and at least one first opening in the first surface;
(b) a second void former element, the second void former element comprising a second surface opposite the first surface and at least one second opening in the second surface, each second opening corresponding to a first opening in the first surface, wherein the first void former element and the second void former element are connected to form a passage between each first opening and its corresponding second opening, and a void space surrounding the passage and further wherein the void former unit is modular in shape to allow for multiple void former units to be connected together, thereby substantially continuously extending:

(c) the first surface;

(d) the second surface; and (e) the void space between the first surface and the second surface, across multiple void former units.

In an embodiment, the first surface and the second surface are substantially flat.

In an embodiment, the first void former element and the second void former element are substantially identical.

In an embodiment, the first void former element comprises a lip extending outward from the first surface about a peripheral edge of the first void former element.

In an embodiment, the void former unit comprises a plurality of apertures to allow a small amount of concrete to seep through during pouring and curing of concrete. Optionally, apertures are only provided in the top surface of the void former unit.

In an embodiment, the first surface and the second surface each comprise surface indents or ribs to reinforce the first void former element and the second void former element, and/or enhance interface load transfer in a resulting concrete element. In an embodiment, at least some of the surface indents or ribs may operate as spacers to separate any reinforcement materials included in a resulting concrete element from the remainder of the void former unit.

In an embodiment, the first void former element is detachably connected to the second void former element. Further in an embodiment, an interlocking mechanism, such as a tongue and groove interlocking mechanism, detachably connects the first void former element to the second void former element. Alternatively, the first void former element and the second void former element are integrally joined or formed as a single unit.

In an embodiment, the first void former element and the second void former element are nestably stackable when not connected to one another.

In an embodiment, the concrete void former unit further comprises a hollow spacer element connecting the, or each, first opening to its corresponding second opening. In an embodiment the hollow spacer element is to be foldable to allow for stacking when not in use as part of the void former unit.

In an embodiment, the void former unit further comprises an insulating body located in a passage between a first opening and a corresponding second opening to improve thermal or sound insulation between the first surface and the second surface.

In an embodiment, the void former unit further comprises at least one side-edge void former element, wherein each side-edge void former element connects the first void former element to the second void former element along a peripheral edge of the void former unit to at least partially enclose the void space surrounding the or each passage.

In an embodiment, the void former unit is integrally formed as a single unit such that such that the first void former element forms a first void former portion integrally joined to the second void former element forming a second void former portion.

In an embodiment, the void former unit is formed of injection-moulded plastic.

In an embodiment, the void former unit comprises a connection means to detachably connect the void former unit to like void former units. In an embodiment, the connection means comprises an interlocking mechanism, such as a tongue and groove interlocking mechanism.

In a second aspect of the invention, there is provided a concrete void former system comprising a plurality of concrete void former units according to a first aspect of the invention, wherein the void former units are connected together so as to provide a substantially continuously extended first surface; second surface, and void space extended between the extended first surface and the extended second surface, across multiple void former units.

In an embodiment, the void former system comprises at least one side-edge void former element, each side-edge void former element connecting a first void former element to its corresponding second void former element along a periphery of the void former system to at least partially enclose a void space formed within the void former system.

In an embodiment, at least one of the void former units comprises a first void former element which comprises a lip extending outward from the first surface of the first void former element about a peripheral edge of the first void former element.

In an embodiment, the concrete void former units are detachably connected. In an embodiment, the detachable connections are formed by a tongue and groove interlocking mechanism.

In a third aspect of the invention, there is provided a method of producing a concrete element comprising:

(a) positioning a void former unit according to the first aspect, or a void former system according to the second aspect, in a mould to provide for a void in a concrete element;

(b) pouring concrete around the void former unit or void former system and within the passage(s) formed between the first opening(s) and the second opening(s) while avoiding pouring concrete into the void space surrounding the passage(s); and (c) allowing the poured concrete to set and cure.

In an embodiment, the method further comprises positioning reinforcing materials in the mould and in the passage(s) so as to reinforce the resulting concrete element.

In an embodiment, the method comprises configuring and or positioning the void former unit or void former system to form an accessible void space within the outer surface the resulting concrete element. Further in an embodiment, the method comprises placing one or more slidably positioned joint reinforcement bar(s) in the accessible void.

In a fourth aspect of the invention, there is provided a concrete element produced according to the third aspect of the invention.

In a fifth aspect of the invention, there is provided a method of connecting a concrete element according to a fourth aspect of the invention to a similar concrete element comprising an accessible void, the method comprising:

(a) placing one concrete element in alignment with the other concrete element such that accessible void spaces within the surface of each cast concrete element are adjacent one another; and (b) pouring concrete into the adjacent accessible void spaces to connect the two cast concrete elements; and (c) allowing the poured concrete to set.

In an embodiment, the concrete element comprises one or more joint reinforcement bar(s) and method further comprises sliding the joint reinforcement bar(s) into the adjacent accessible void space of the adjacent concrete element prior to pouring concrete into the adjacent accessible void spaces.

In a sixth aspect of the invention there is provided a construction element when produced by the method of the fifth aspect of the invention.

The present summary is provided only by way of example, and not limitation. Other aspects of the present invention will be appreciated in view of the entirety of the present disclosure, including the entire text, claims and accompanying figures.

BRIEF DESCRIPTION OF THE FIGURES

In FIG. 43 a multi-layer approach is shown in which two layers of void former units are exemplified.

Figure 1:
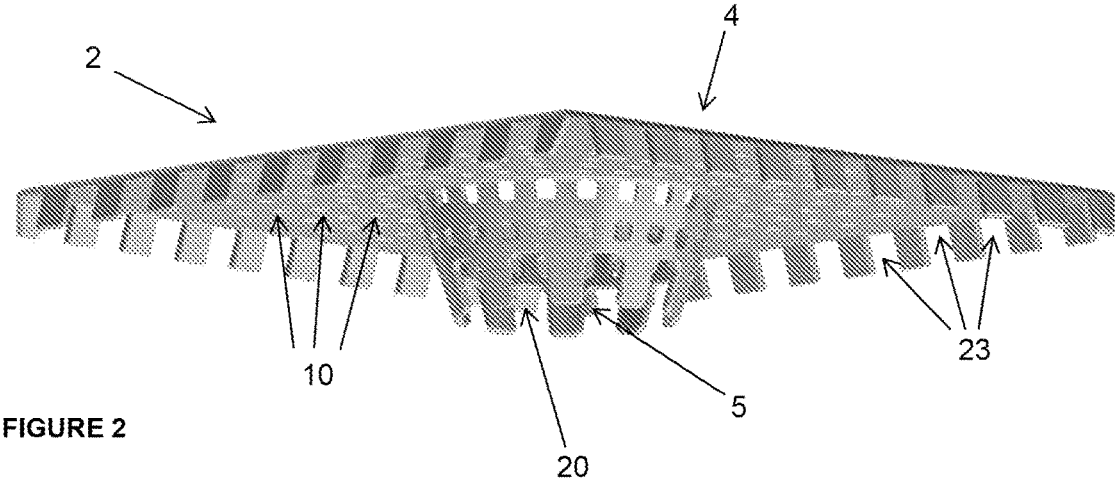
FIG. 1 shows a first void former element according to an embodiment of the invention.

While the above-identified figures set forth one or more embodiments of the present invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features, steps and/or components not specifically shown in the drawings.

DETAILED DESCRIPTION

An embodiment according to the first aspect of the invention is now described by reference to FIGS. 1 to 3. FIG. 3 shows a void former unit 1 comprising a first void former element 2 (similar to that shown in FIG. 1), and a second void former element 3 (similar to that shown in FIG. 2).

FIG. 1 shows a first void former element 2 comprising a substantially flat, square first surface 4 and a first opening 5 in the first surface 4. Opposite the first surface 4, the first opening 5 projects downward to provide a position for detachably connecting the first void former element 2 to a second void former element 3.

While the device is shown as having a square, substantially flat, first surface 4, it is noted that other shapes may be utilized to for example allow for other geometries, including: curved or angled geometries. For example, where a curved concrete surface or element is desired, the first surface may be rounded accordingly. Rather than use a square geometry as shown in FIG. 1, in certain embodiments other shaped may be used such as triangular, pentagonal, hexagonal. Shapes capable of forming tessellation with other void former elements 1 may be preferred for certain embodiments, but are not essential.

Figure 2:
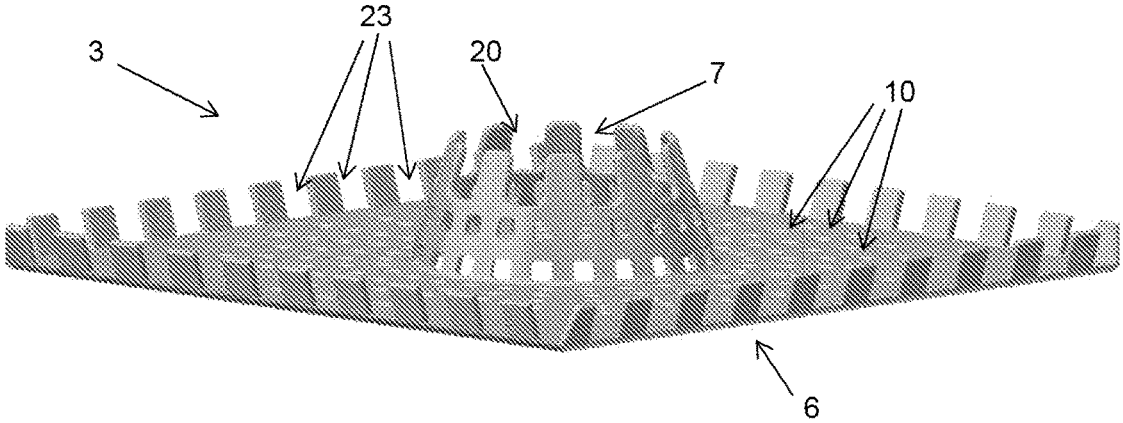
FIG. 2 shows a second void former element according to an embodiment of the invention.
Figure 3:
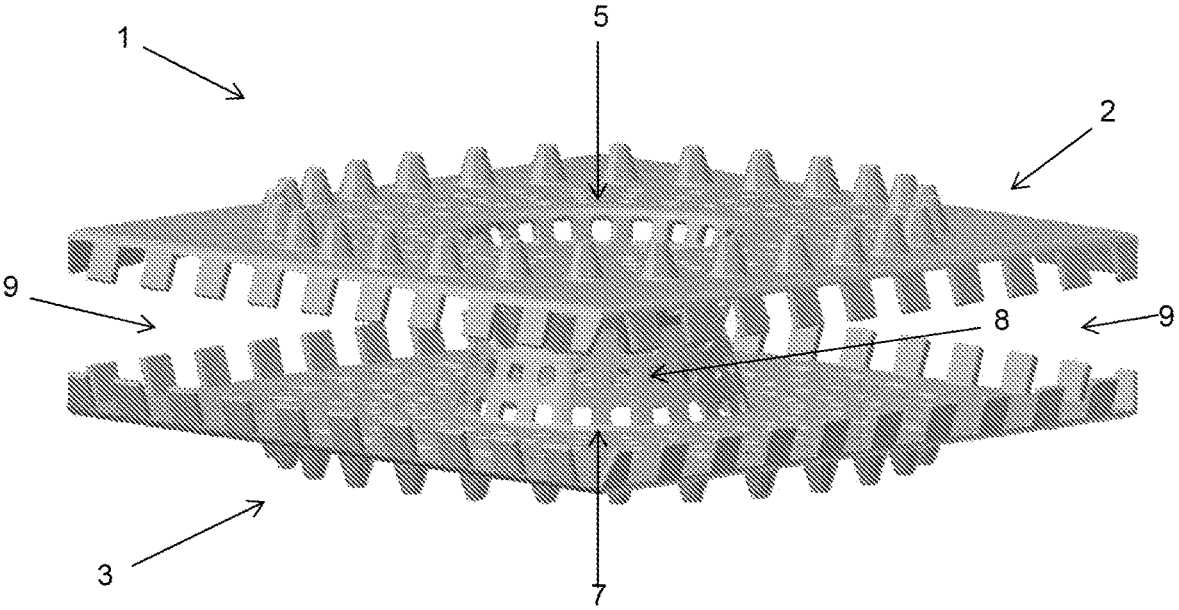
FIG. 3 shows a void former unit comprising a first void former element and a second void former element according to an embodiment of the invention.

FIG. 2 shows a second void former element 3 comprising a substantially flat second surface 6, and a second opening 7 in the second surface 6. Opposite the second surface 6, the second opening 7 projects upward to provide a mechanism for detachably connecting the second void former element 3 to a first void former element 2.

As may be appreciated the second void former element 3 shown in FIG. 2 is actually identical to the first void former element 2 of FIG. 1, such that a first void former element 2 may provide a second void element 3 by simply flipping the element over. Further, the first void former element 2 and the second void former element 3 are nestably stackable so as save storage and transport space when disconnected.

FIG. 3 shows a void former unit 1 comprising a first void former element 2 similar to that of FIG. 1 connected to the second void former element 3 similar to that of FIG. 2. As shown, the void former unit provides a passage 8 between the first opening 5 and the second opening 7. In use, concrete is poured into and cured within the passage 8 so as to provide a strut in a concrete element, while void space 9 is formed in the space surrounding the passage 8. Without wishing to be bound by theory, the struts are believed to:

(a) resist hydrostatic pressure on the concrete elements 18 during casting of concrete in the void space 9; and
(b) provide permanent shear strength in the cast concrete element (especially 'shear' and 'punching shear' strength), especially when in certain embodiments concrete fills the void space 9 formed by the void former unit in a second pour (as exemplified in FIGS. 21-30).

As shown in FIGS. 1-3, the first void former element 2 and the second void former element 3 are detachably connected by an interlocking tongue and groove style mechanism 20. This mechanism may analogously be applied to detachably connect other elements of the void former unit 1 together. It may also be used to connect multiple void former units 1 together using a peripheral interlocking tongue and groove mechanism 23 surrounding the peripheral edge of the first void former element 2 and the second void former element 3. While an interlocking mechanism as shown is preferable, other connection means are envisaged such as gluing, taping, welding, Velcro, or click-fit buttons. Joining as proposed is further exemplified in respect of FIGS. 16 and 17.

As shown in FIGS. 1-3, the first void former element 2 and the second void former element 3 each comprise apertures 10 to allow small amounts of concrete to seep through, which:

(a) relieves hydrostatic pressure when the concrete is poured; and
(b) embeds the void former unit 1 in the concrete to minimise movement; and
(c) enables contact with any concrete filling the void space 9 formed by the void former unit 1 from a second stage pour (as exemplified in FIGS. 21-30).

Figure 4:
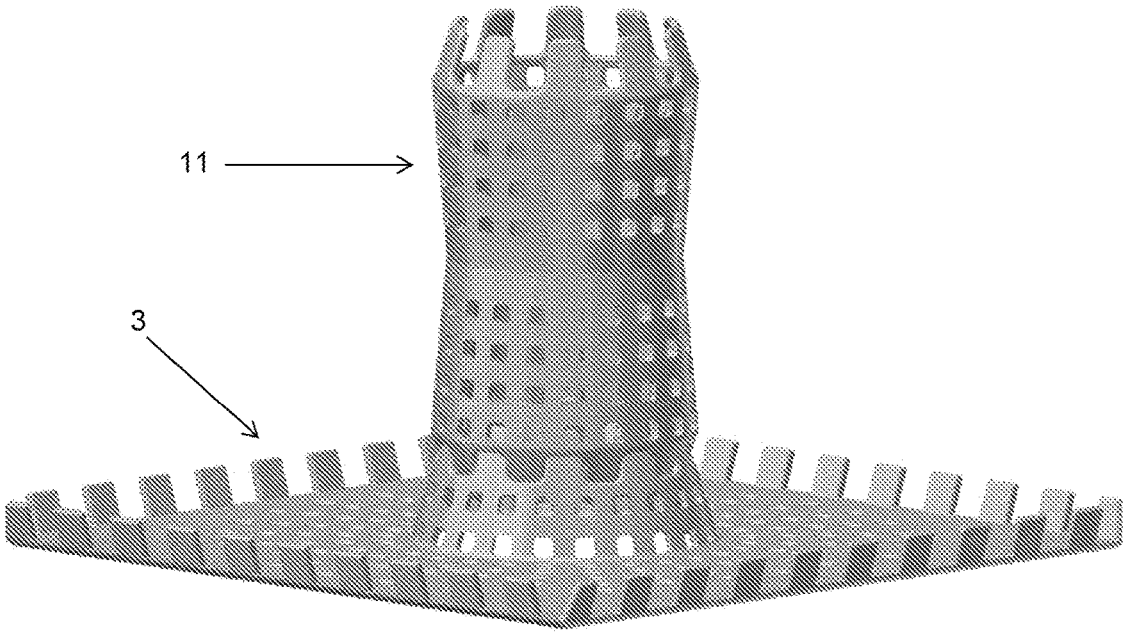
FIG. 4 shows a second void former element connected to a hollow spacer element according to an embodiment of the invention.
Figure 5:
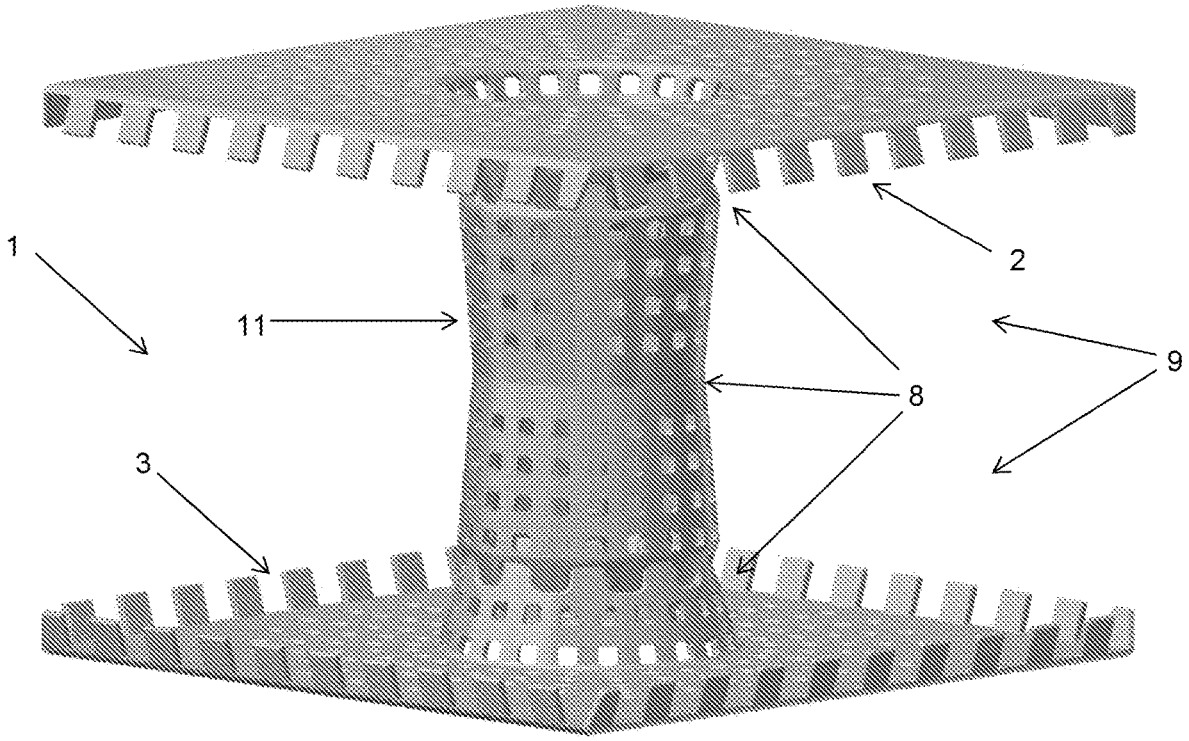
FIG. 5 shows a void former unit comprising a first void former element and a second void former element connected via a hollow spacer element according to an embodiment of the invention.
Figure 44:
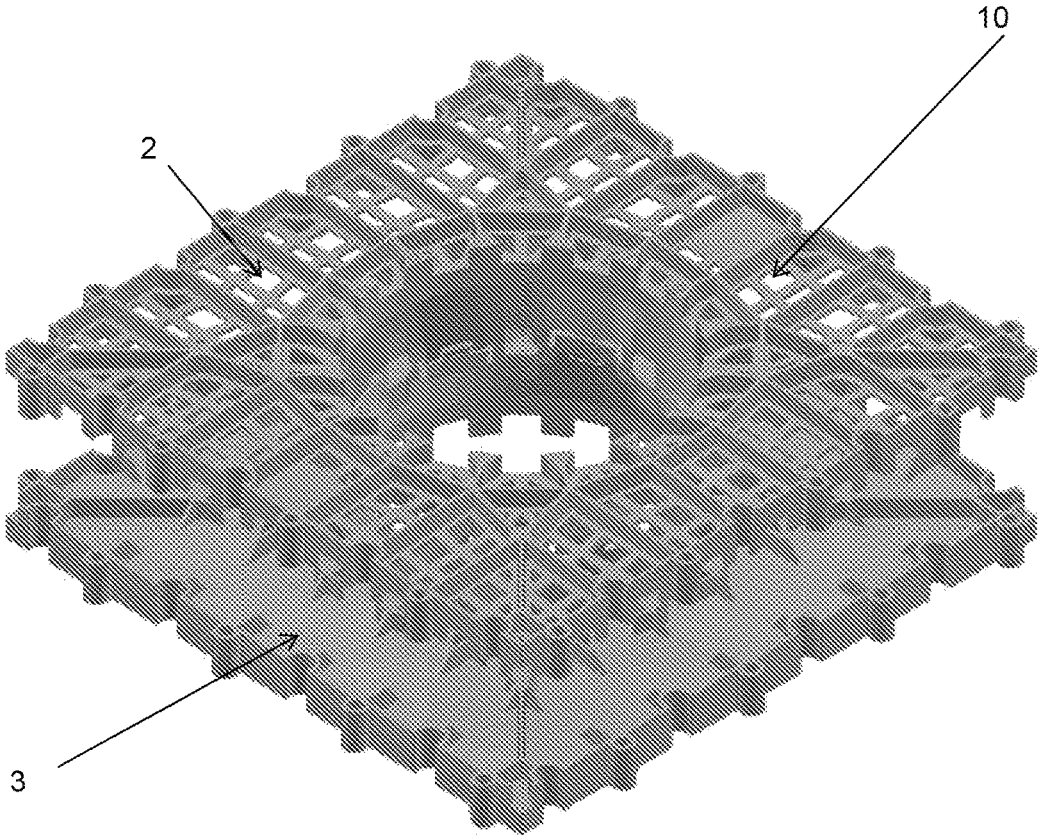
FIGS. 44 and 45 show void former units configured for horticultural uses.
Figure 45:
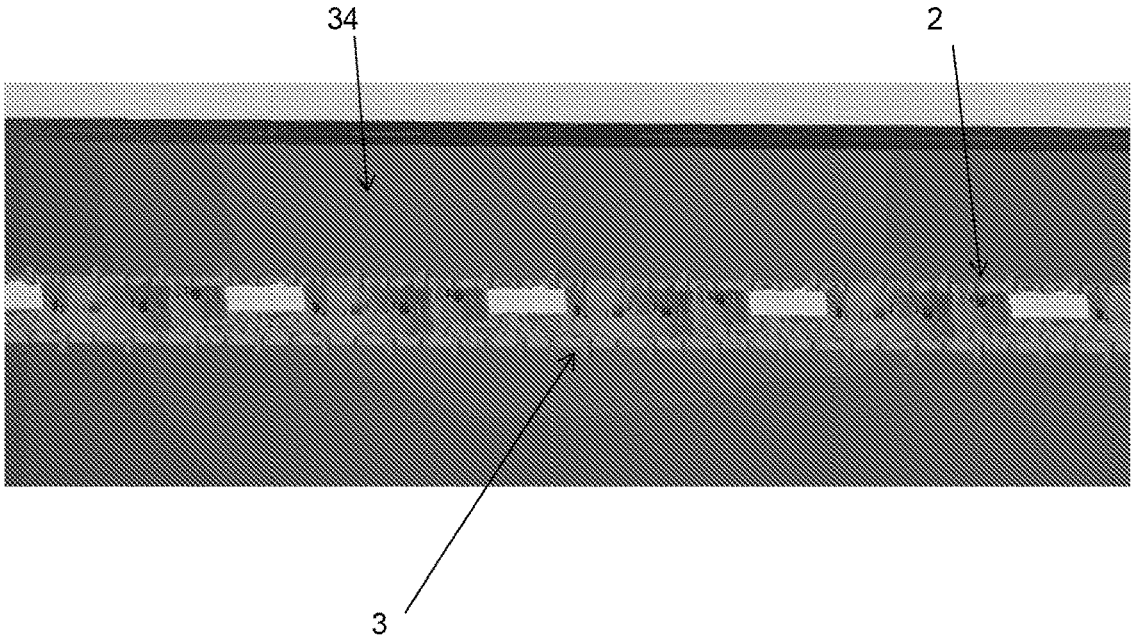

It is envisaged that other components of the void former unit 1 may also comprise apertures 10 as for example shown in FIGS. 4 and 5, which are now discussed.

Where the void former units 1 are used for horticultural applications, apertures configured to allow for water and plant roots to pass may be found solely in the top surface 4 of the void former unit such that water may be captured in the void former unit 1 or void former system 15, which in turn supplies plant roots passing through the top surface with stored water. An embodiment such as that proposed is shown in FIGS. 44 and 45.

In the embodiment shown in FIGS. 4 and 5, the void former unit 1 further comprises a hollow spacer element 11, which separates the first void former element 2 from the second void former element 3, thereby adjusting the length of the resulting passage 8 and the height of the surrounding void space 9. Variations in void space 9 thickness may therefore be accommodated via the use of different length hollow spacer elements 11. In FIG. 4, the void former unit 1 is partially assembled to demonstrate the detachable nature of the connection between the hollow spacer element 11 and the first void former element 2.

Figure 6:
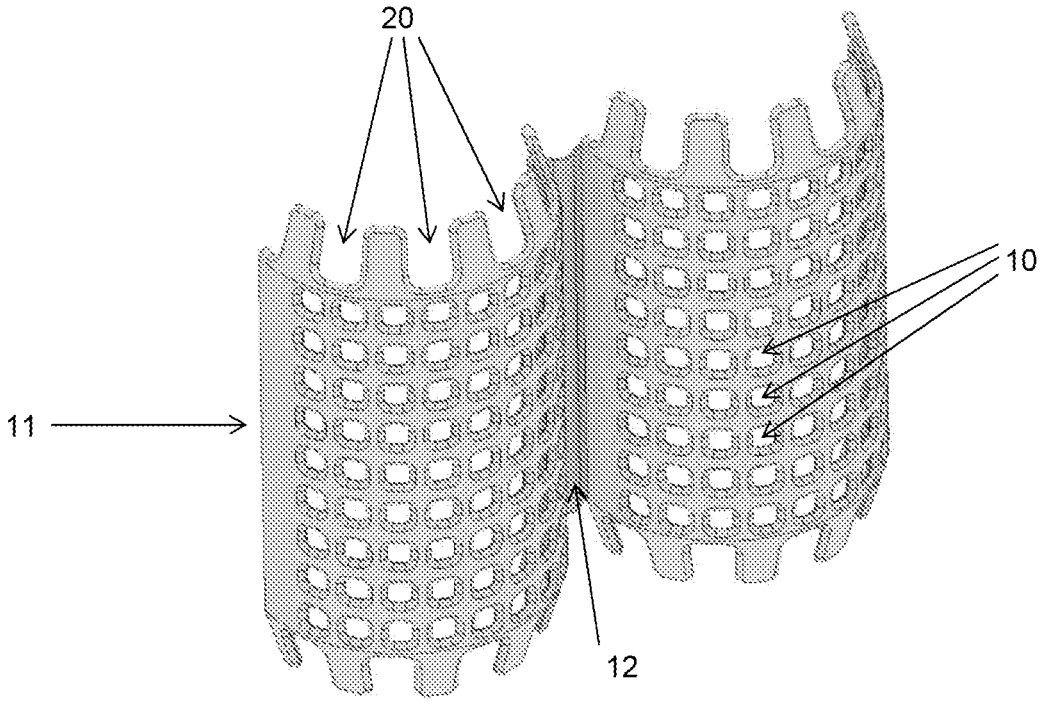
FIG. 6 shows a foldable hollow spacer element according to an embodiment of the invention.

FIG. 6 shows a foldable hollow spacer element 11 according to an embodiment of the invention. The foldable hollow spacer element 11 comprises a fold line 12 along its length, and is split apart opposite the fold line 12. When not in use the hollow spacer element 11 may be unfolded as shown in FIG. 6 to allow for stacking during storage.

Figure 7:
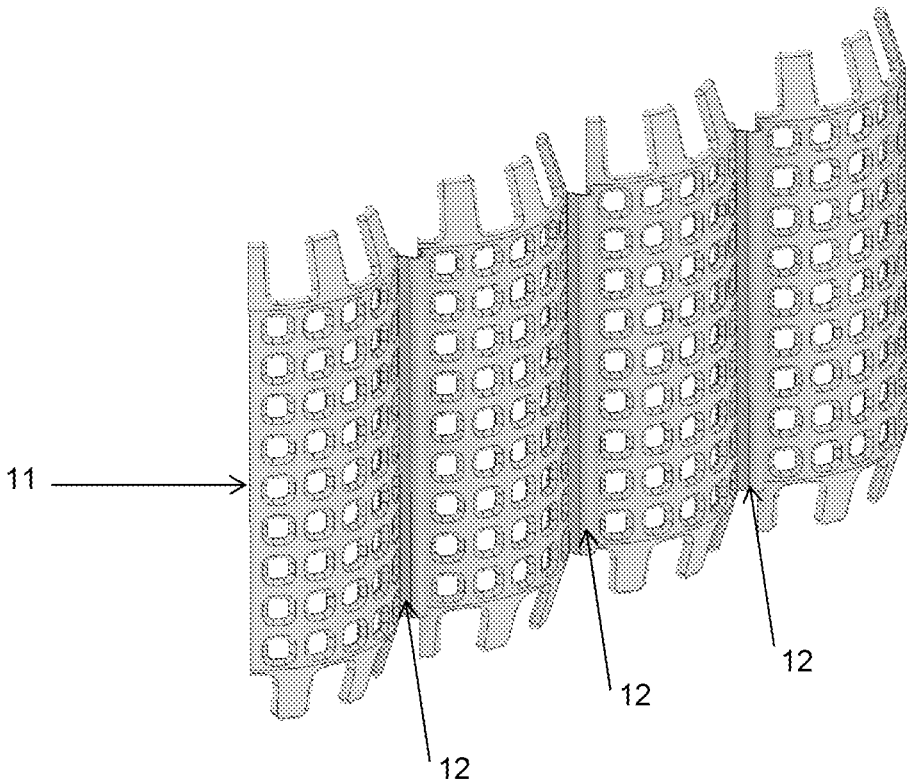
FIG. 7 shows another foldable hollow spacer element according to an embodiment of the invention.

FIG. 7 shows another hollow spacer element 11 similar to that of FIG. 6, however the hollow spacer element 11 comprises three distinct fold lines 12. It is believed that the embodiment shown in FIG. 7 provides a flatter profile for stacking than that of FIG. 6, while potentially being easier to manufacture.

Each of the void former elements may be manufactured using plastic via injection moulding techniques, but other methods can be used such as thermoforming, 3D printing and CNC routing, particularly where bespoke geometries are required. To ensure fire performance, plastic void former elements should be kept sufficiently isolated from exposure to fire.

Other types of material could also be used to form void former elements, such as sheet-metal, in which case production processes could include stamping and pressing. Particularly where a strong material such as steel or glass reinforced plastic is used, the void former unit 1 may contribute to the overall strength/reinforcement of the concrete element. Otherwise, the stiffness of the void former elements must at least be sufficient to resist hydrostatic pressures from the concrete in its wet state and resist other minor loads during manufacturing operations.

In an embodiment, the adopted materials would be sourced sustainably such as via the recycling of waste.

Figure 8:
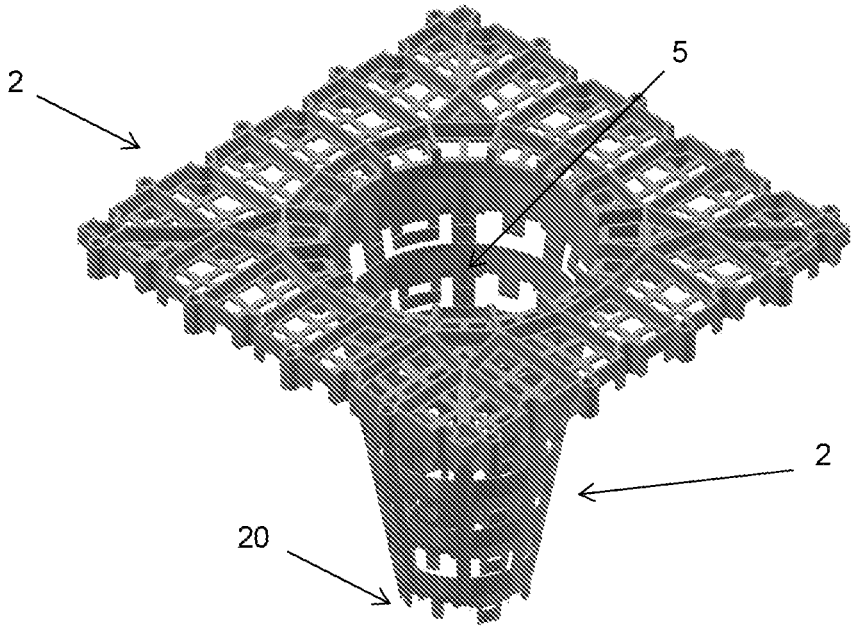
FIG. 8 shows an alternative first void former element according to an embodiment of the invention.
Figure 9:
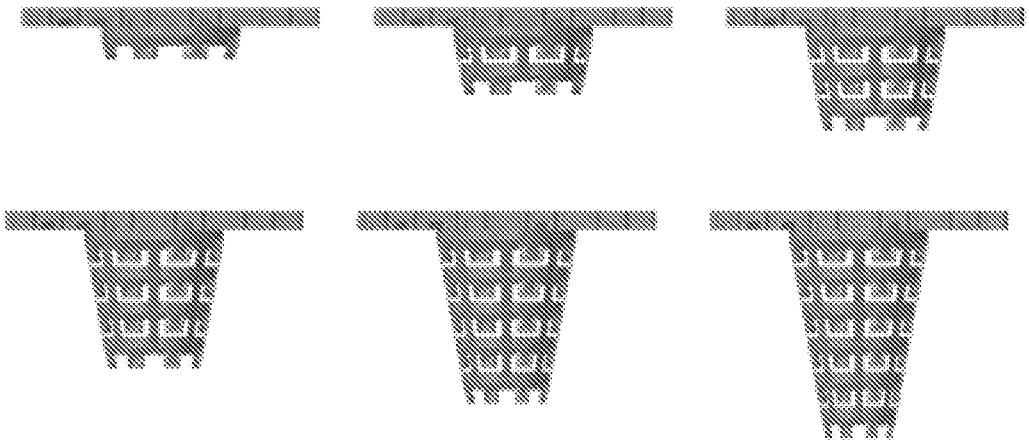
FIG. 9 shows a range of first void former elements according to embodiments of the invention such as that shown in FIG. 8, wherein the void former elements comprise a first opening projecting at different lengths from a first surface to allow for passages of various lengths between a first void former element and a second void former element.

FIG. 8 shows another embodiment of a first void former element 2 in which the first surface 4 of the first void former element is ribbed to provide additional structural strength to the first void former unit 2, as well as providing further contact between the first surface 4 and setting concrete. In the embodiment shown the first opening 5 also projects further away from the first surface 4, such that substantial distances can be obtained between the first surface 4 and second surface 6 of a void former unit 1 without requiring a hollow spacer element 11. FIG. 9 shows first void former elements 2, demonstrating the manner in which the projection of the first opening 5 may vary between embodiments of the invention. Joining of first void former elements 2 and second void former elements 3 as shown in FIGS. 8 and 9 to form a void former unit 1 is demonstrated in FIG. 20.

Figure 10:
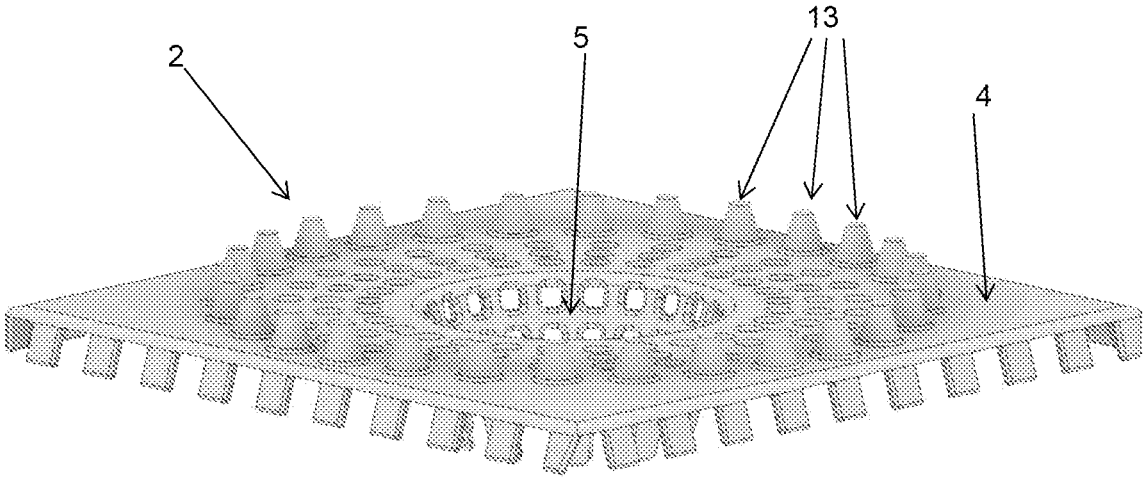
FIG. 10 shows a first void former element comprising a plurality of apertures and surface indentations according to an embodiment of the invention.

FIG. 10 shows a first void former element 2 according to an embodiment of the invention in which the first surface 4 comprises indentations 13 to enhance the interface load transfer capability during and after concrete casting. As shown, the indentations 13 may project outward from the first surface 5. In an embodiment, such indentations 13 may space reinforcement materials from the remainder of the first surface 4 during casting, thus allowing adequate flow of concrete around the reinforcement materials.

Figure 11:
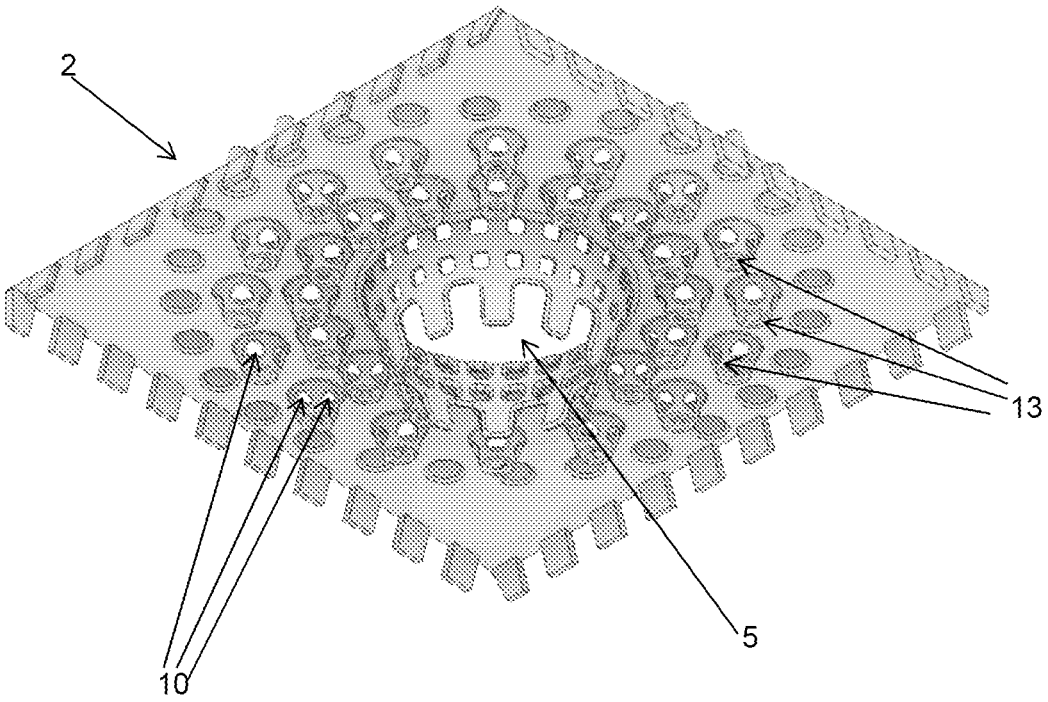
FIG. 11 shows another first void former element comprising a plurality apertures and surface indentations according to an embodiment of the invention.

FIG. 11 shows a first void former element 2 according to another embodiment of the invention, in which the indentations project inward from the first surface 4. The indentations 13 may in themselves comprise apertures 10, which are believed to further relieve hydrostatic pressure, and enhance interface load transfer capabilities.

While indentations 13 are shown in respect of a first void former element 2, they can be equally applied in respect of a second void former element 3 (which may be identical to the first void former element 2 as previously described).

Figure 12:
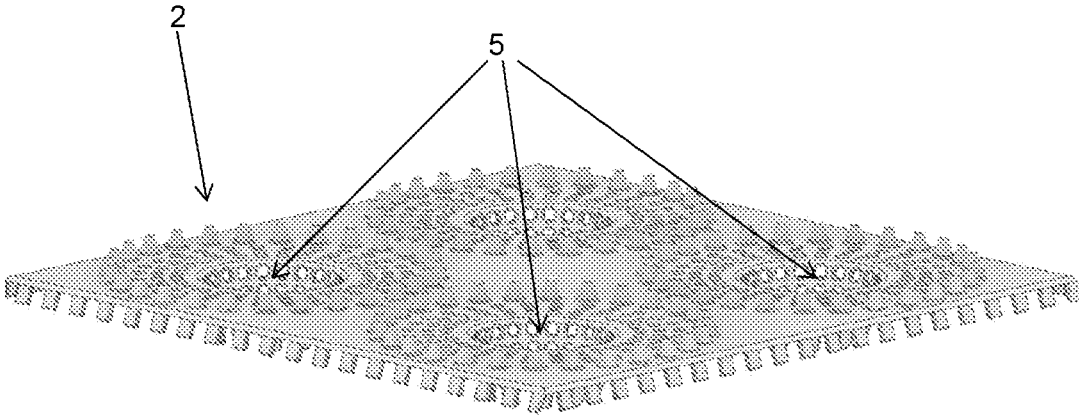
FIG. 12 shows a first void former element comprising four first openings in its first surface according to an embodiment of the invention.
Figure 13:
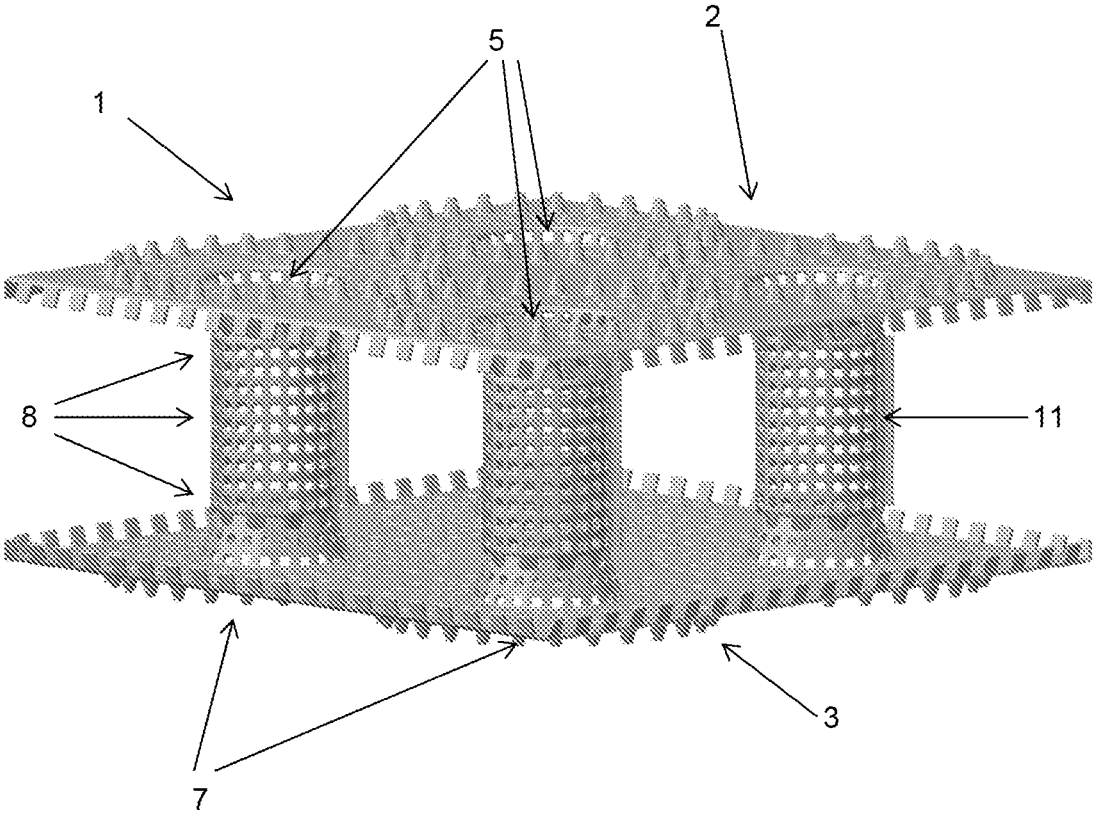
FIG. 13 shows a void former unit comprising the first void former element of FIG. 12 according to an embodiment of the invention.
Figure 14:
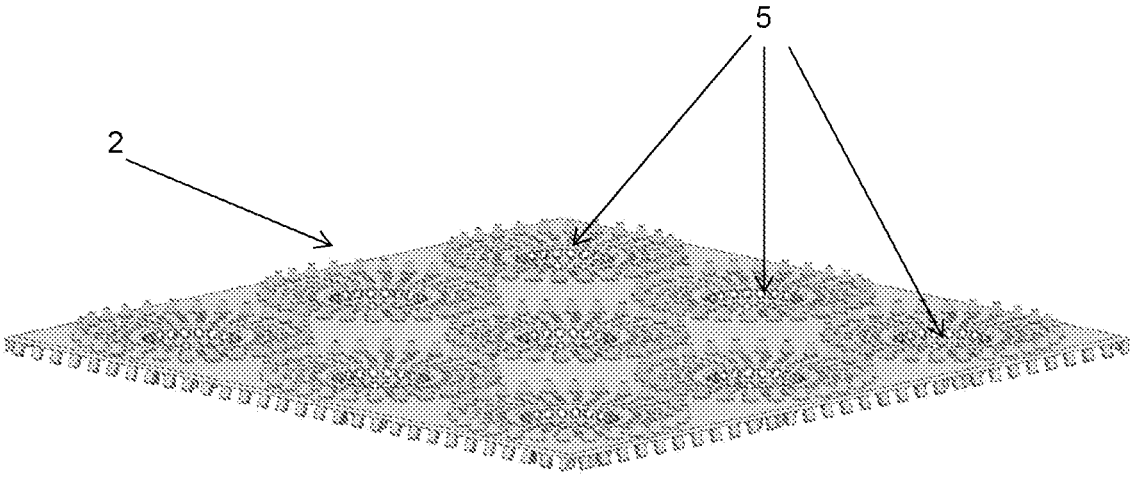
FIG. 14 shows a void former unit comprising nine first openings in its first surface according to an embodiment of the invention.
Figure 15:
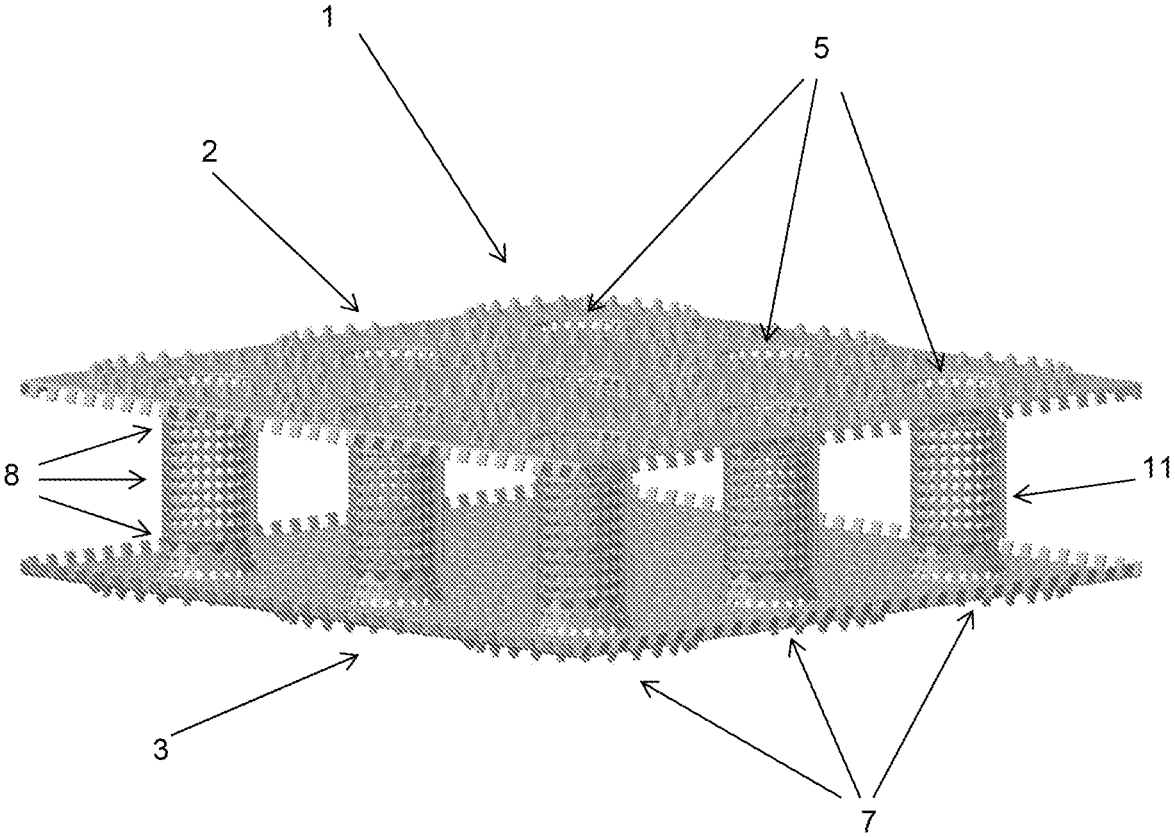
FIG. 15 shows a void former unit comprising the first void former element of FIG. 14 according to an embodiment of the invention.

FIGS. 12-15 demonstrate a void former unit 1 in which the first void former element 2 comprises more than one first opening 5, and the second void former element 3 correspondingly comprises more than one second opening 7. The void former unit 1 thereby comprises multiple passages 8 to allow for larger void former units 1 to reduce the number of void former units required in a given void former system 15. In FIGS. 12 and 13 the void former unit 1 provides four passages 8, while in FIGS. 14 and 15 the void former unit 1 provides nine passages 8.

FIGS. 1-15 demonstrate a void former unit 1 in which elements such as the first void former element 2 and the second void former element 3 are separate components that may be connected together. However, it may be appreciated that the void former unit 1 may be provided as a single integrally formed unit, such as via injection moulding or 3D printing. Alternatively, the void former unit 1 may be assembled from separate components such that, for example two components form respective halves of the void former unit 1 by also forming two halves of the first void former element 2, the second void former element 3 and any other part of the void former unit 1. While not shown, this may be envisaged as splitting a void former unit 1 similar to that of FIG. 3 or 5 in half vertically.

Figure 16:
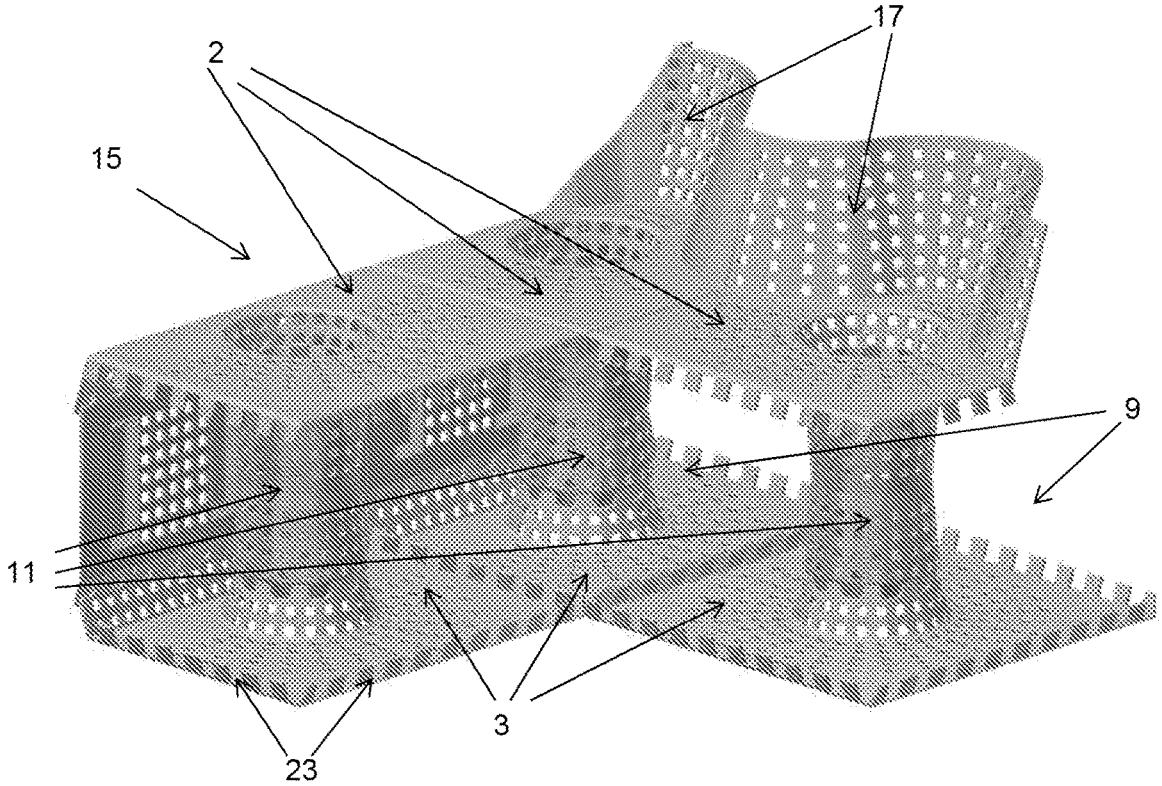
FIG. 16 shows a partially complete void former system comprising side-edge void former element and wherein some of the first void former elements comprise a lip extending from the first surface.
Figure 17:
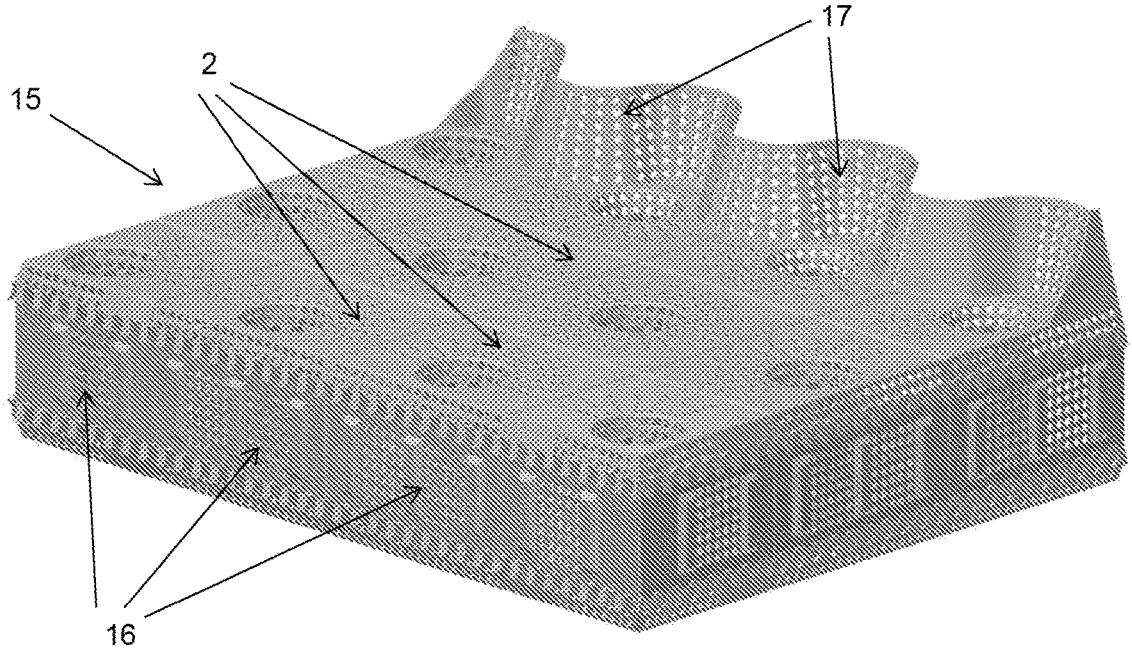
FIG. 17 shows the void former system of FIG. 16 as complete.

An embodiment of the invention according to its second aspect is now described by reference to FIGS. 16 and 17. FIG. 16 shows a partially completed void former system 15 comprising a plurality of void former units 1 detachably connected to one another to provide an extended first surface 4, an extended second surface 6 (not shown), as well as a single, continuous void space 9. This is achieved by connecting first void former elements 2 to adjacent first void former elements 2, and likewise second void former elements 3 to adjacent second void former elements 3. To ensure that concrete does not enter the void space 9, the void former system 15 further comprises a plurality of side-edge void former e 16, each detachably connecting a first void former element 2 to its corresponding second void former element 3 along a periphery of the void former system 15. As shown, first void former elements 2 along one side of the void former system comprise a lip 17 extending upward about a peripheral edge of the extended first surface 4 to prevent concrete from flowing over the lip 17. Void former units 1 comprising the lipped first void former elements 2 may therefore cooperate with a mould to provide an access opening in a cast concrete element, as explained further with reference to FIGS. 21-30. FIG. 17 shows a void former system 15 ready for use in a mould.

Figure 18:
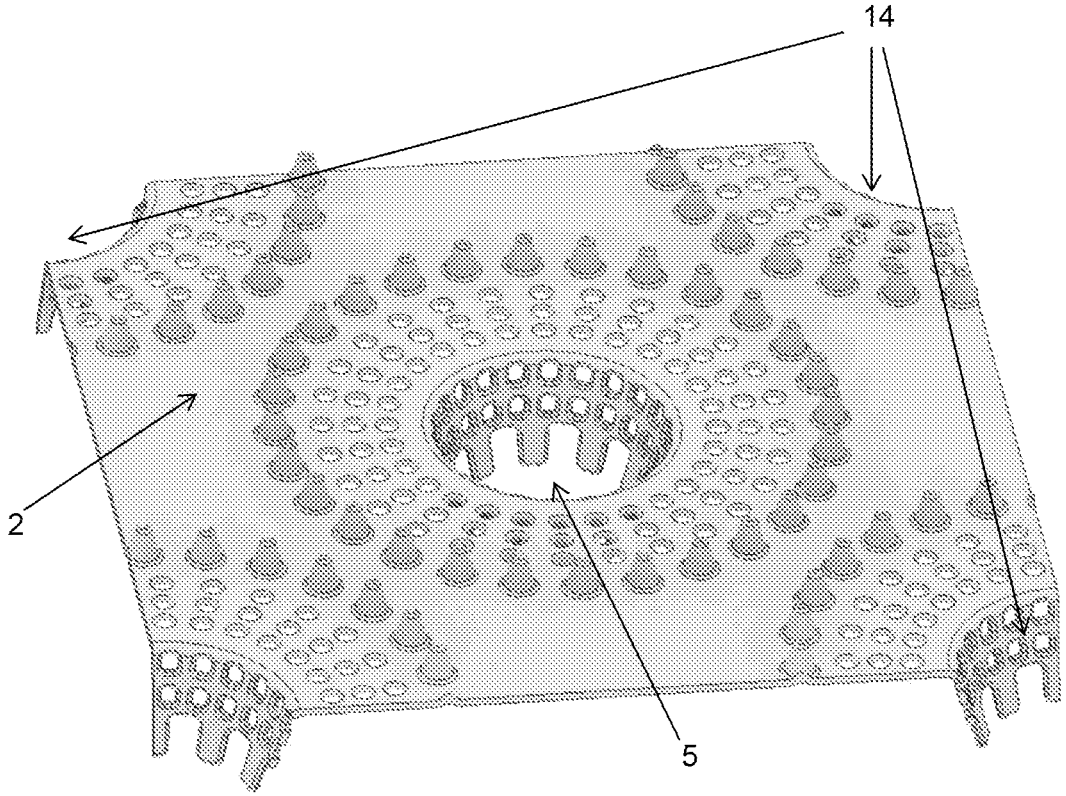
FIG. 18 shows a first void former element comprising one portions of an opening at each corner of the first surface according to an embodiment of the invention.
Figure 19:
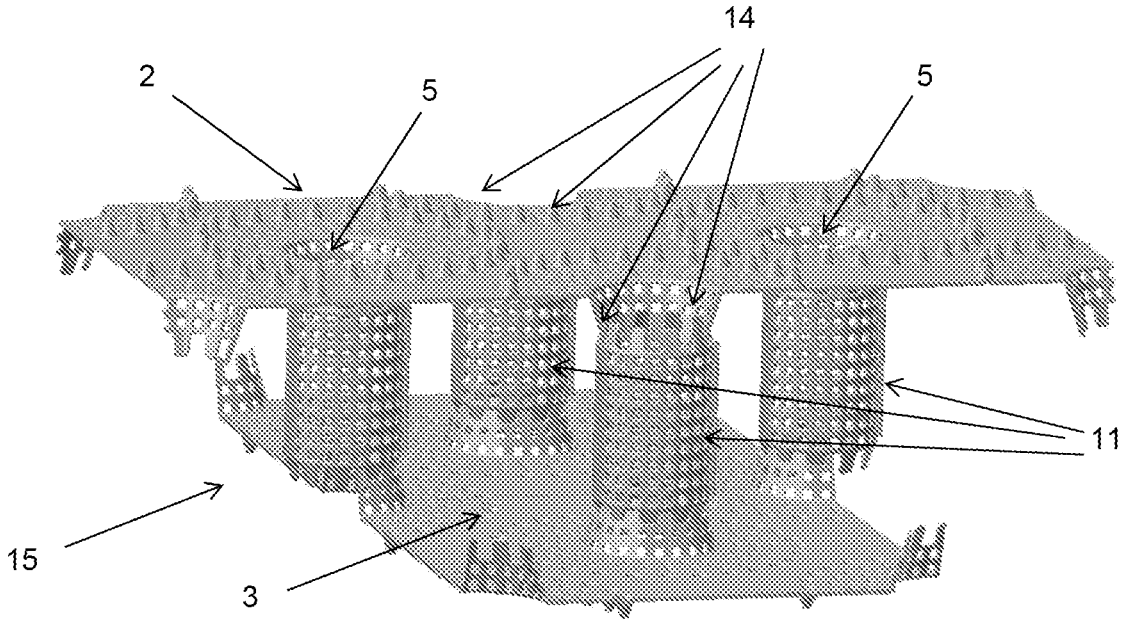
FIG. 19 shows a void former system comprising first void former elements as shown in FIG. 18.

FIGS. 18 and 19 show an alternative embodiment of the void former unit 1 and void former system 15 in which the first surface 4 of each first void former element 2 comprises opening portions 14 at each corner of its perimeter. Thus, when forming a void former system 15, cooperative openings are formed as first void former elements 2 are connected together. The opening portions 14 may provide the additional benefit of providing a mechanism to connect first void former elements 2 together through mutual connection to a single hollow spacer element 11. In this embodiment the perimeter of the first void former element 2 does not necessarily comprise any interlocking mechanism 23.

Figure 20:
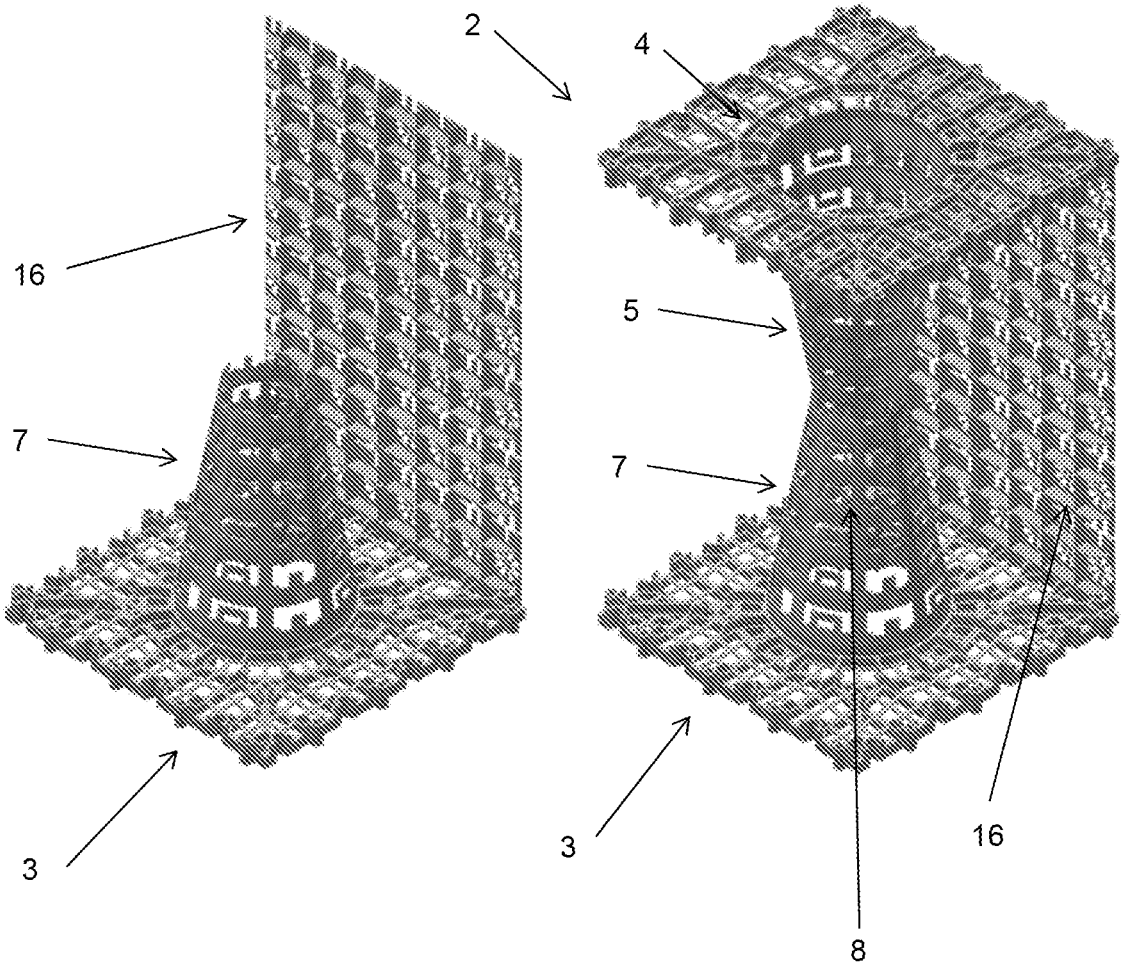
FIG. 20 shows a first void former and a second void former according to embodiments exemplified in FIGS. 8 and 9, joined together to form a void former unit with a side edge void former element.
Figure 21:
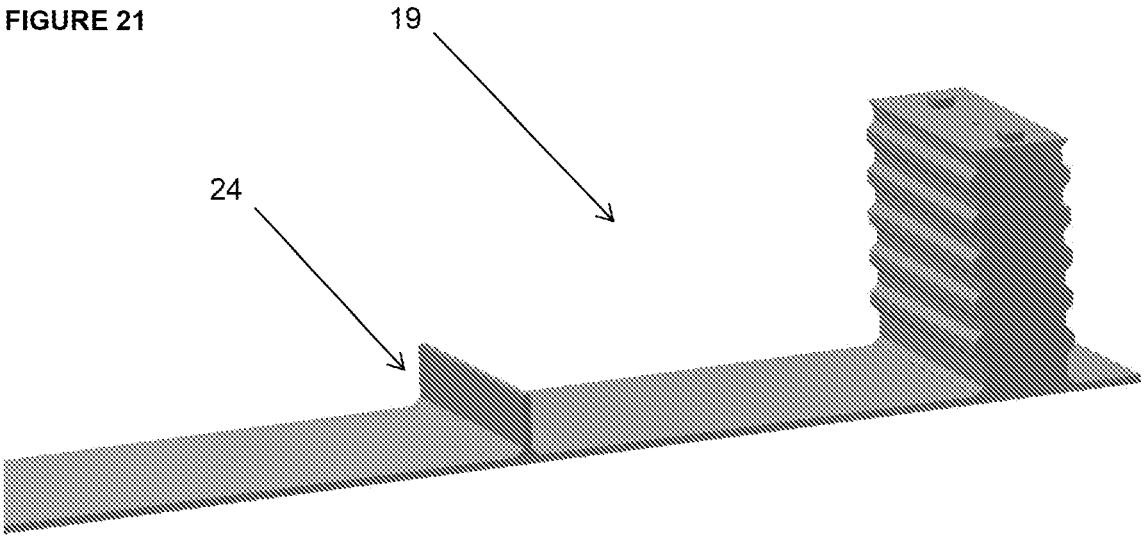
FIGS. 21-30 show step-wise a method of producing a concrete element in a mould according to an embodiment of the invention.

FIG. 20 shows the joining of a first void former element 2 and a second void former element 3, in which both void former elements are configured according to the embodiments shown in FIGS. 8 and 9. As shown, the first opening 5 and the second opening 7 project such that a substantial distance is achieved between the first surface 4 and the second surface 6 without requiring a hollow spacer element 11. Consistent with the embodiments shown in FIGS. 8 and 9, the first surface 4 and the second surface 6 are each ribbed to provide increased structural support and increased contact with concrete. Similarly, the side-edge void former element 16 shown is also ribbed to provide increased structural support and increased contact with concrete.

A method of forming precast concrete elements 18 in a match-casting mould using a void former system 15 is now described with reference to FIGS. 21-30. The disclosed match-casting system allows for multiple concrete elements 18 to be cast together, transported separately to a construction site, and then connected together onsite as part of a construction project. While a match-casting mould is exemplified, the person skill in the art will appreciate that concrete elements may otherwise be cast in any number of moulding/casting configurations including single element batch casting.

A cross section of an empty match-casting mould 19 is shown in FIG. 18. The mould 19 enables production of more than one concrete element at a time in a match-casting arrangement, whereby the concrete elements are separated by shutters 30 in the mould 19.

Figure 22:
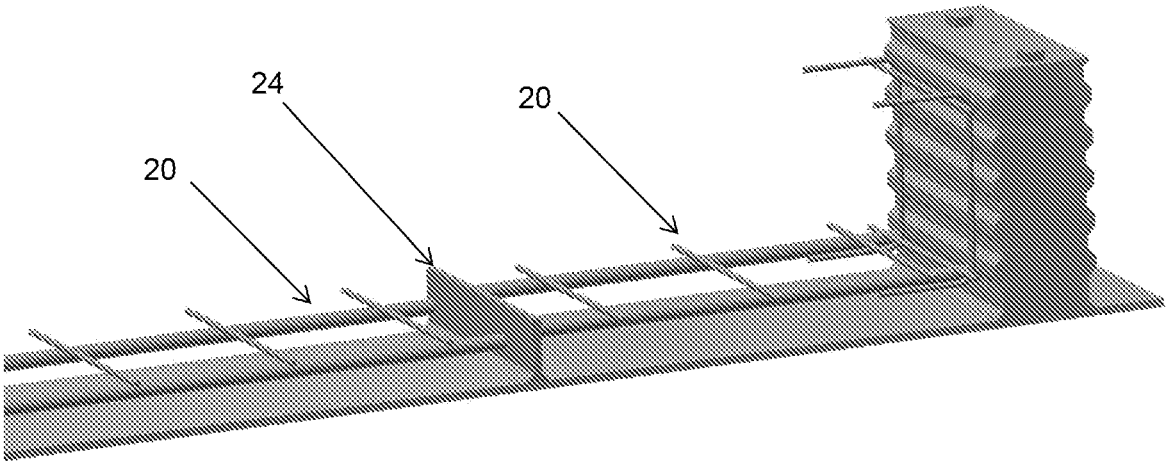

Reinforcement 20 is firstly placed in the mould 19 as shown in FIG. 22. As shown, reinforcement 20 is placed on either side of the shutter 24 to provide for two separate cast concrete elements 18. Reinforcement is typically provided in two directions, using reinforcement bars, mesh, prestressing wires, metal fibres and/or other such suitable fibrous materials.

Figure 23:
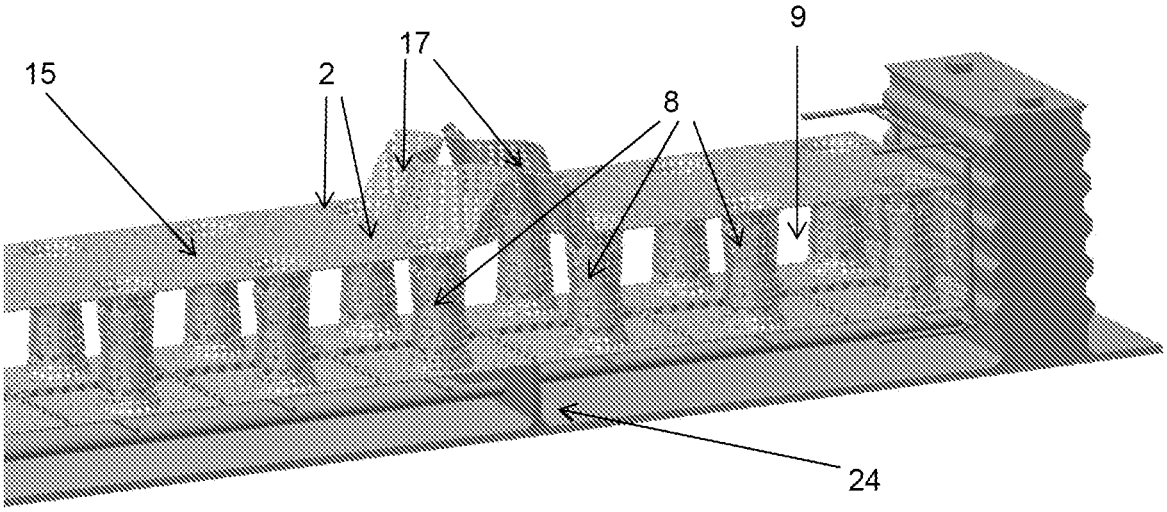

A void former system 15 is then placed over the reinforcement 20 as shown in FIG. 23. In the embodiment shown, the void former system 15 includes void former units 1 comprising opposing first void former elements 2 with lips 17, which cooperate with the shutter 24 to separate the cast concrete elements 19. As shown in FIG. 23, the separated concrete elements 19 share a common void space in the mould, which is left open by the gap formed between the opposing first void former elements 2 with lips 17.

Figure 24:
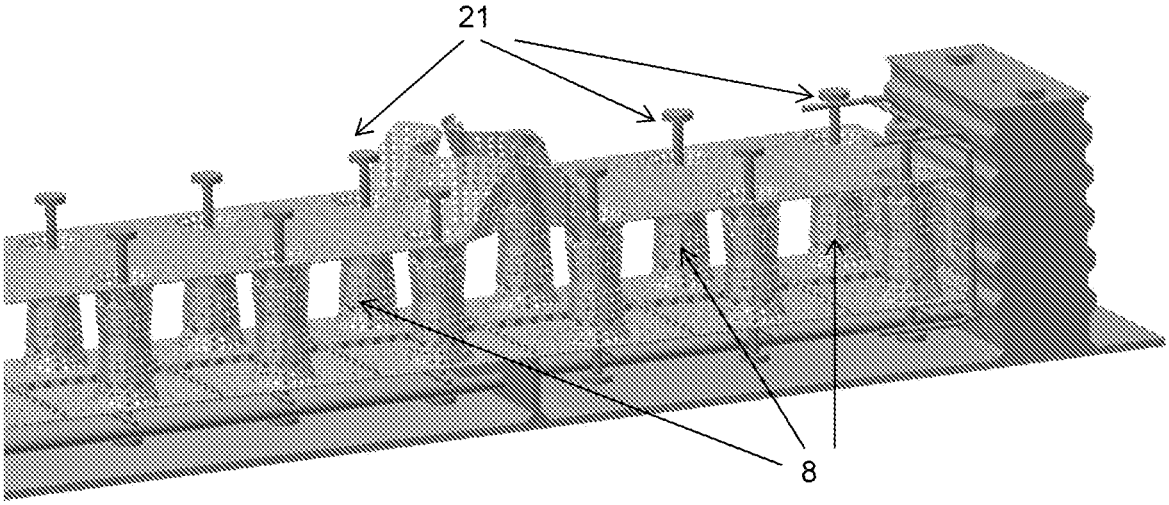
Figure 25:
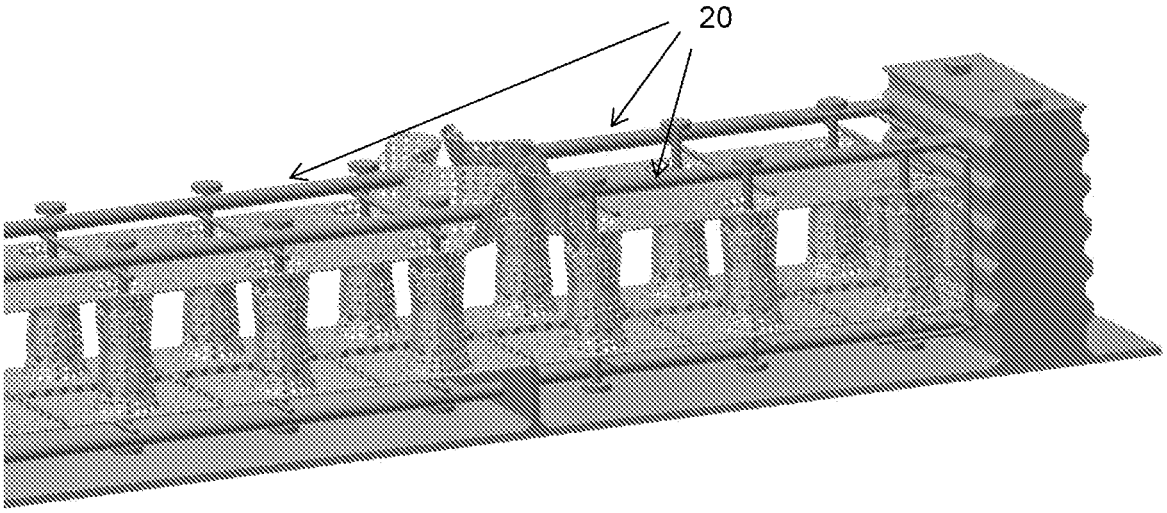

Once the void former system is in place, reinforcing stud assemblies 21 may be positioned within passages 8 in the void former system 15 (as shown in FIG. 24). While stud assemblies 21 are exemplified, other suitable reinforcement material may be used, such as reinforcing fibres. In an embodiment, no reinforcement material need be used. Further reinforcement 20 is placed over the void former system 15 to reinforce the top layer of the two concrete elements 18 (as shown in FIG. 25). While not shown, it is envisaged that the mould may allow for more than one layer of void former systems 15 such that the concrete element 18 is provided with, for example, three horizontal layers of concrete separated by two void spaces. Concrete elements of such configuration are exemplified by FIG. 43.

Figure 26:
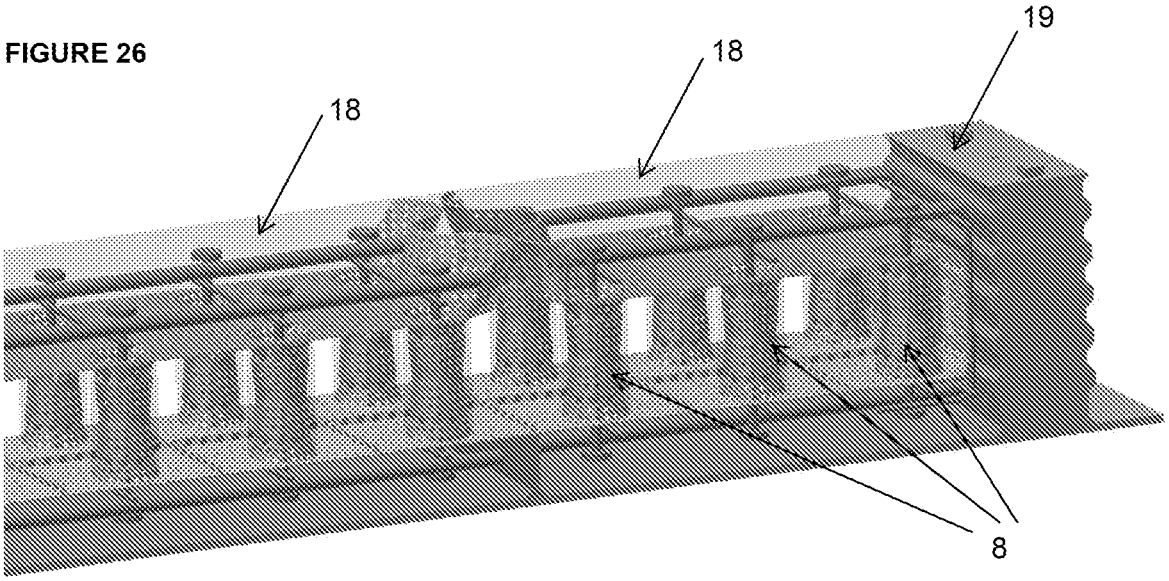

In FIG. 26 wet concrete is poured into the mould 19 and over the void former system 15. The concrete flows though the passages 8 and into to the bottom of the mould 19, thereby forming a bottom layer of concrete. The concrete will then fill the passages 8 and in turn the top layer above the void former system 15. Concrete is not poured into the void space 9 shared between the two concrete elements 18 at this stage. That is, it is not poured into gap formed between the opposing first void former elements 2 with lips 17.

Figure 27:
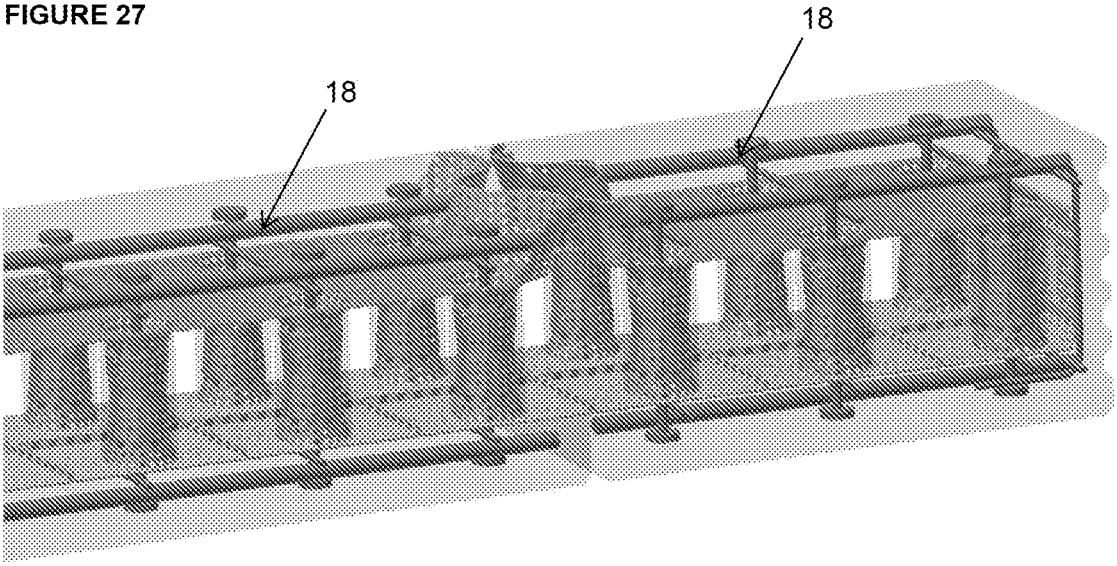

After the concrete is poured it is allowed to set and cure in the mould 19. Once the concrete has obtained sufficient strength the cast concrete elements 18 may be removed from the mould 19 as shown in FIG. 27. While not shown, the cast concrete elements 18 may be separated and transported to a construction site where they may be again positioned in alignment to each other.

Figure 28:
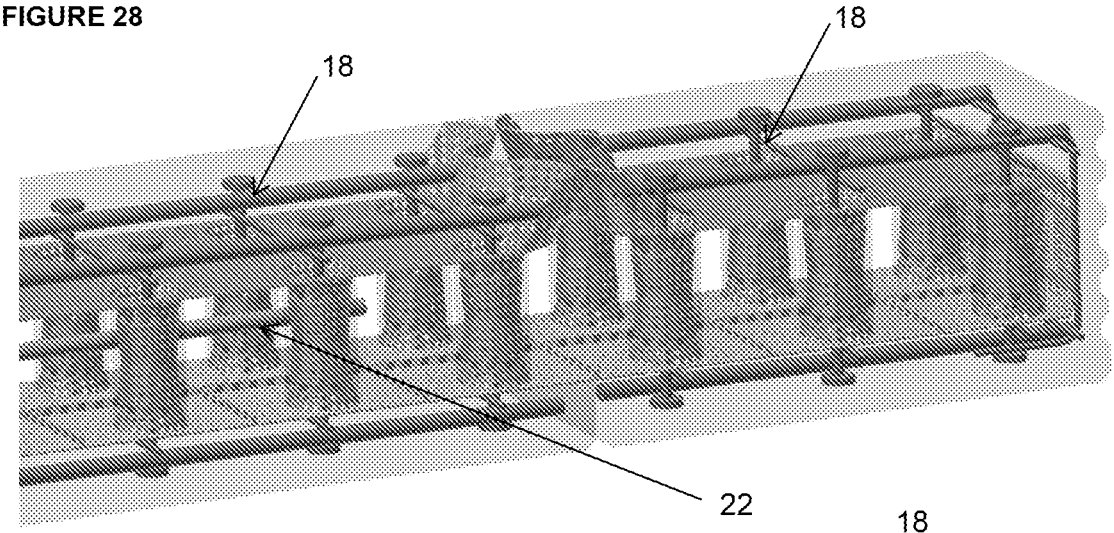
Figure 29:
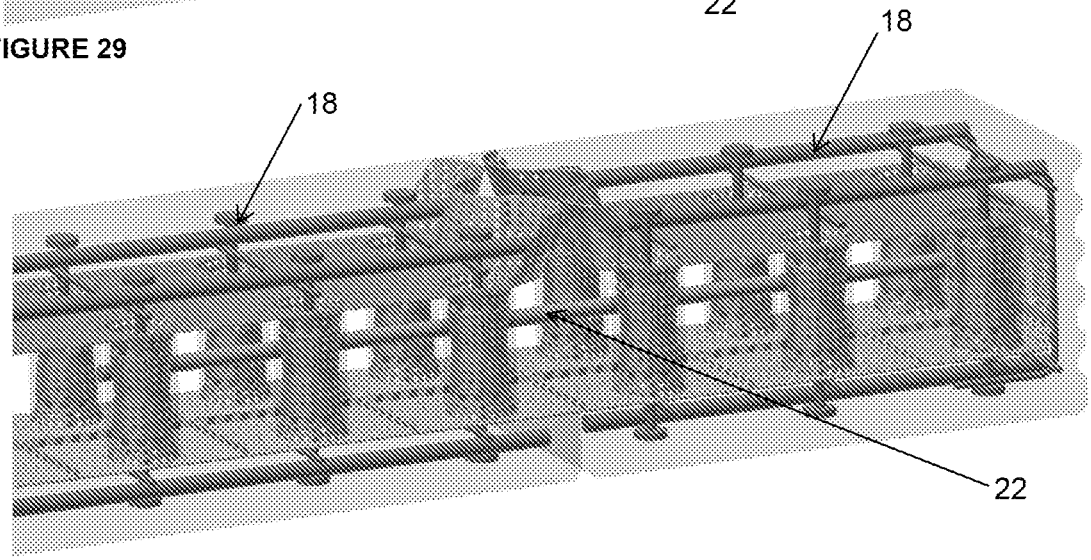

Prior to transport, or at the construction site, a concrete element 18 may be loaded with at least one, in an embodiment multiple joint-reinforcement bars 25 positioned within its void space 9 (see FIG. 28). The joint-reinforcement bars 25 reinforce the connection between connected concrete elements 18, and when the concrete element 18 is positioned next to another concrete element 18, the joint reinforcement bars 25 are slid into the corresponding void space of the other concrete element 18 as shown in FIG. 29.

Figure 30:
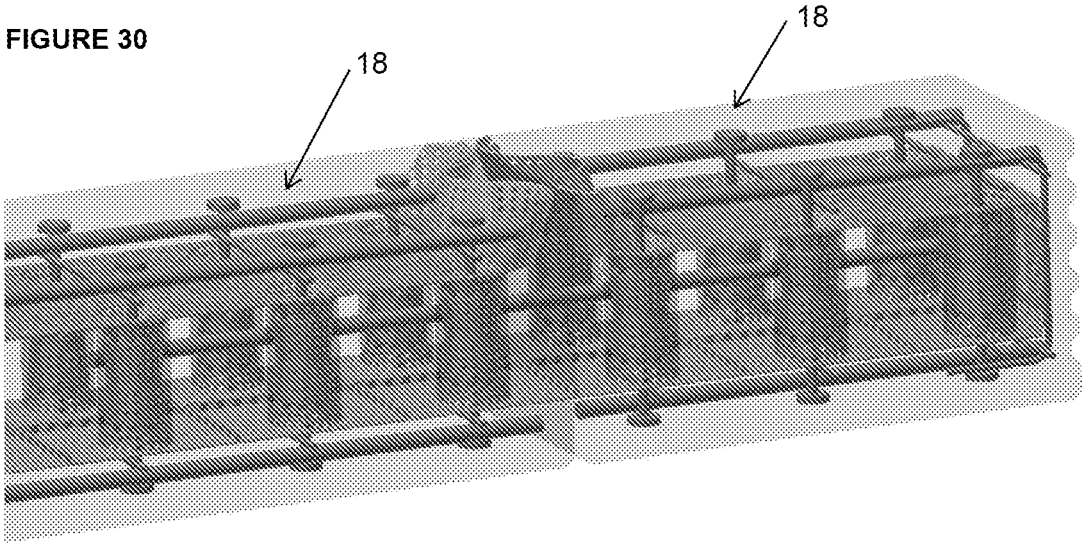

Concrete is then poured into the gap between concrete elements 18. As concrete is poured into the gap it fills the void space shared by the two concrete elements 18, thereby connecting the two concrete elements 18 together as shown in FIG. 30.

While not shown in FIGS. 21-30, it will be appreciated that the entirety of the void space 9 formed within a concrete element 18 by the void former system 15 need not be filled to join the two concrete elements 18. In fact, to do so may prevent many of the advantages of forming void spaces in concrete elements as previously discussed. To prevent concrete from completely filling a void space, the void former system 15 may for example incorporate side-edge void former elements 16 which internally divide the void space 9 into an accessible void space in the surface of the concrete element 18, and an internal void space. Upon joining two like concrete elements 18 only the two accessible void spaces are filled with concrete such that the joined construction element still comprises unfilled internal void spaces.

In an embodiment (shown in FIGS. 31 and 32), the void former system 15 may comprise one or more sleeve elements 26, within which one or more joint reinforcement bar(s) 25 may be slidably positioned such that, in use the joint reinforcement bar(s) 25 slides from a storage position to a reinforcing position within the accessible voids of adjacent concrete elements 18. Use of the sleeve elements 26 allows for two particular advantages:

(a) easy pre-positioning of the joint-reinforcement bar(s) 25 prior to transport or positioning of a concrete element 18; and (b) correct and simple positioning of the joint-reinforcement bar(s) 25 while concrete elements 18 are joined (i.e. while concrete sets in the common void space).

Figure 31:
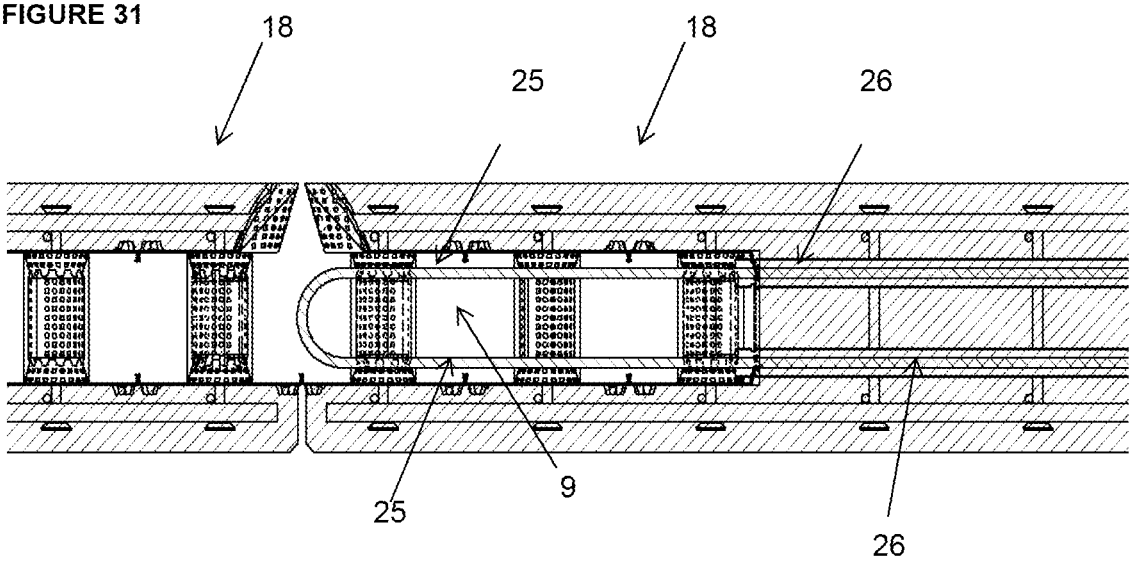
FIG. 31 shows a concrete element comprising a void former unit that further comprises sleeve elements to pre-load a joint reinforcement bar.
Figure 32:
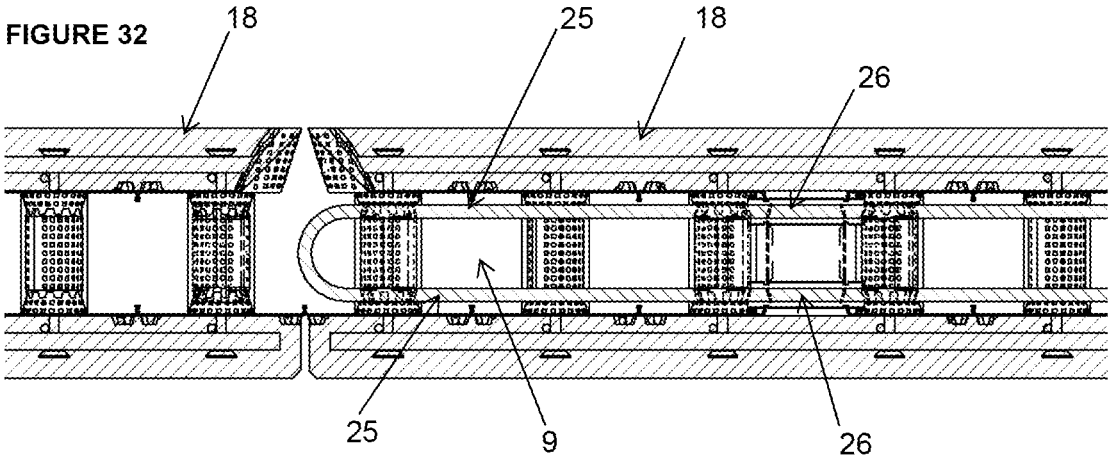
FIG. 32 shows another concrete element comprising a void former unit that further comprises sleeve elements to pre-load a joint reinforcement bar.

The sleeve elements 26 may be provided completely within a void space 9 of a void former system 15 (as shown in FIG. 32), or it may extend beyond the void space 9 such that concrete is cast about the sleeve elements 26 (within which the joint reinforcement bar(s) 25 is slidably housed) when the concrete element 18 is first cast (as shown in FIG. 31).

Figure 33:
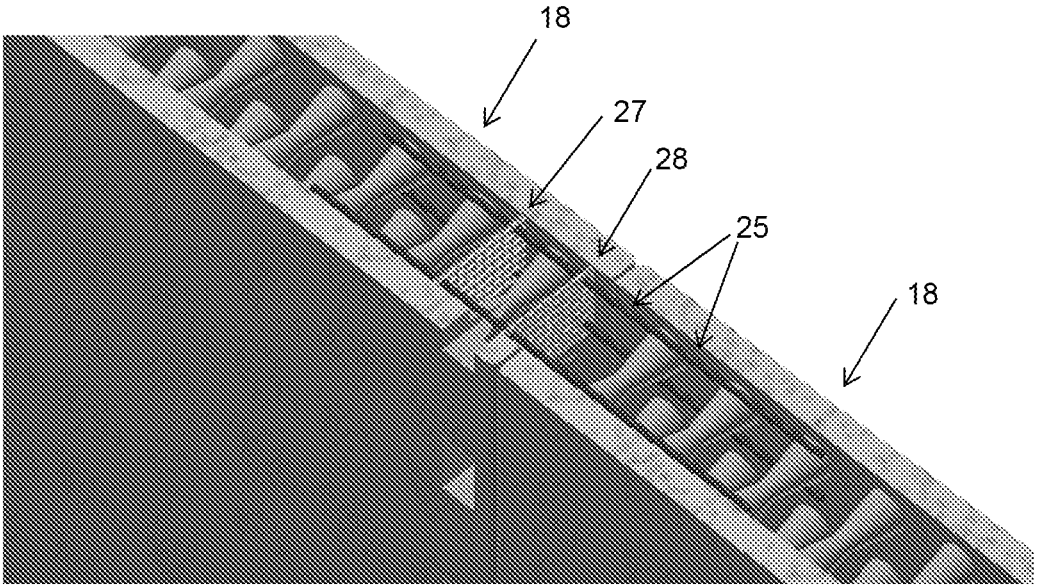
FIG. 33 shows the joining of concrete elements according to an embodiment of the invention, in which the concrete elements are joined in a parallel configuration.
Figure 34:
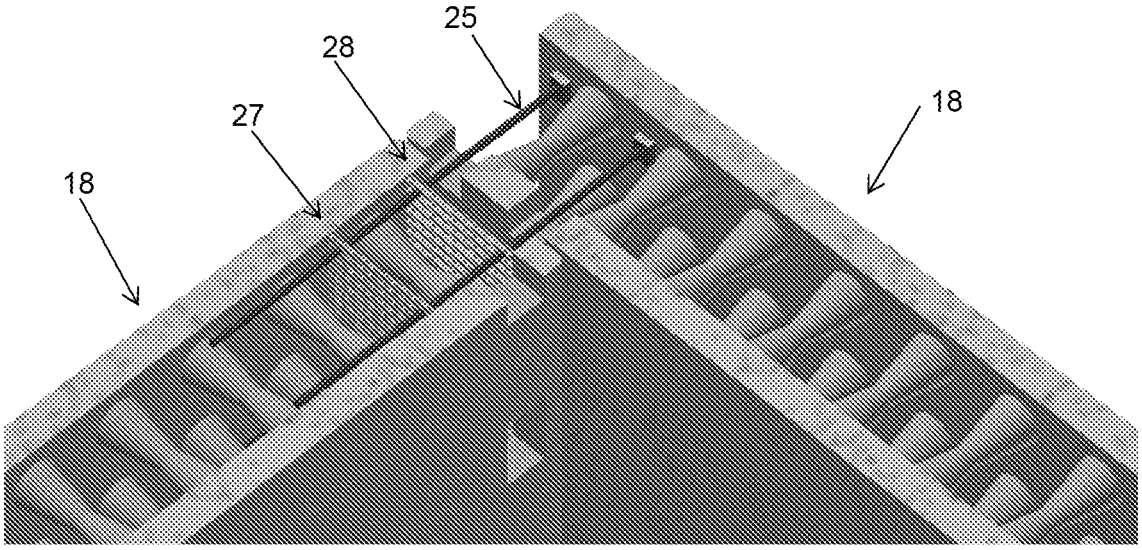
FIG. 34 shows the joining of concrete elements according to an embodiment of the invention, in which the concrete elements are joined perpendicular to one another.
Figure 35:
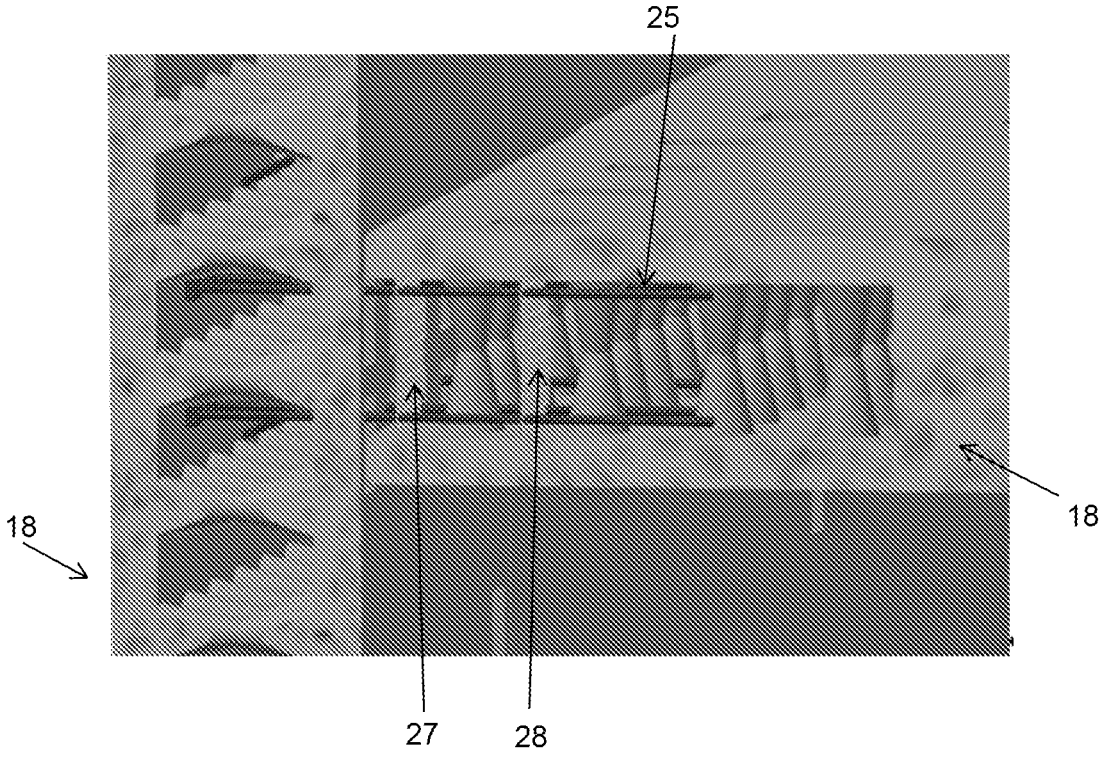
FIG. 35 shows the joining of concrete elements according to an embodiment of the invention, in which the concrete elements are also joined perpendicular to one another.

As shown in FIGS. 33 to 35 concrete elements 18 may joined together at various angles to one another. For example, concrete elements 18 may be joined in parallel (as shown in FIG. 33), or concrete elements 18 may be joined perpendicular to one another (as shown in FIGS. 34 and 35). In the embodiments shown, joint reinforcement bars 25 are, rather than being housed in sleeve elements 26 slidably housed by two adjacent mesh walls 27 within a concrete element 18 (rather than through use of sleeves). Also, access holes 28 are provided in the outer surface of the concrete element 18 to provide access to the join reinforcement bars 25. Access holes 28 can be provided by simply blocking out a volume during concrete casting using a removable wooden block or similar.

Figure 36:
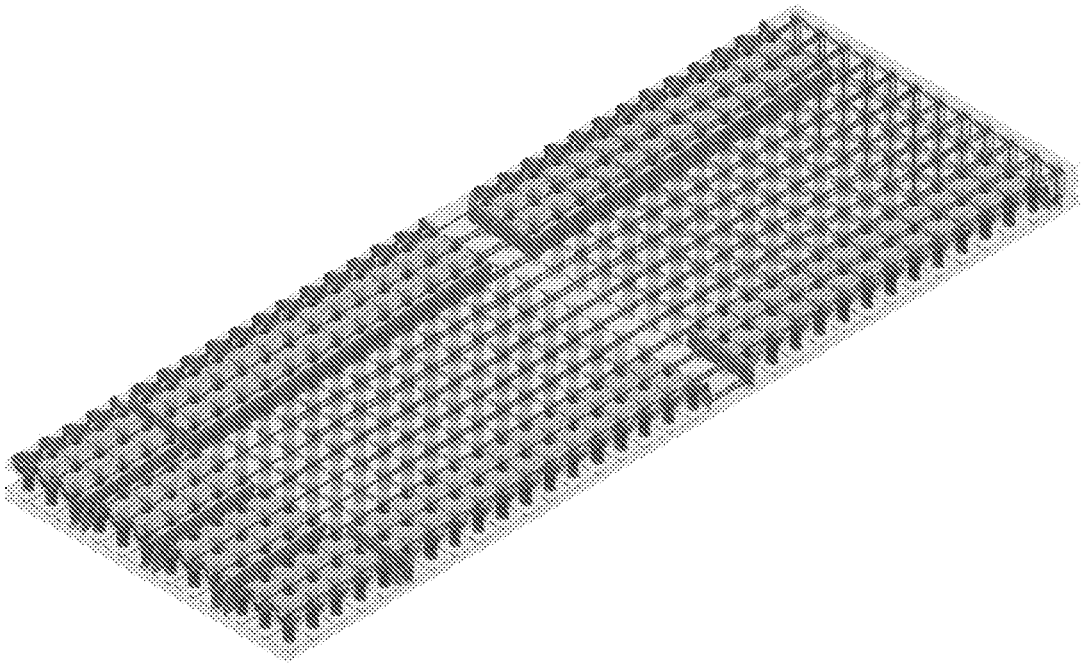
FIGS. 36-38 show concrete elements joined together to form larger construction elements according to embodiments of the invention.
Figure 37:
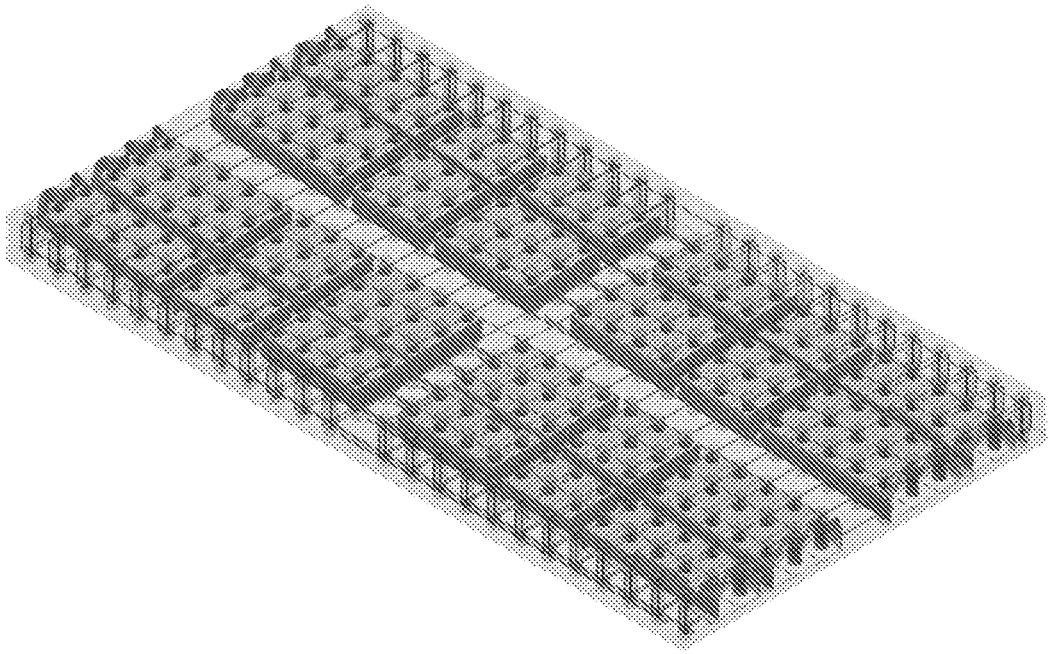
Figure 38:
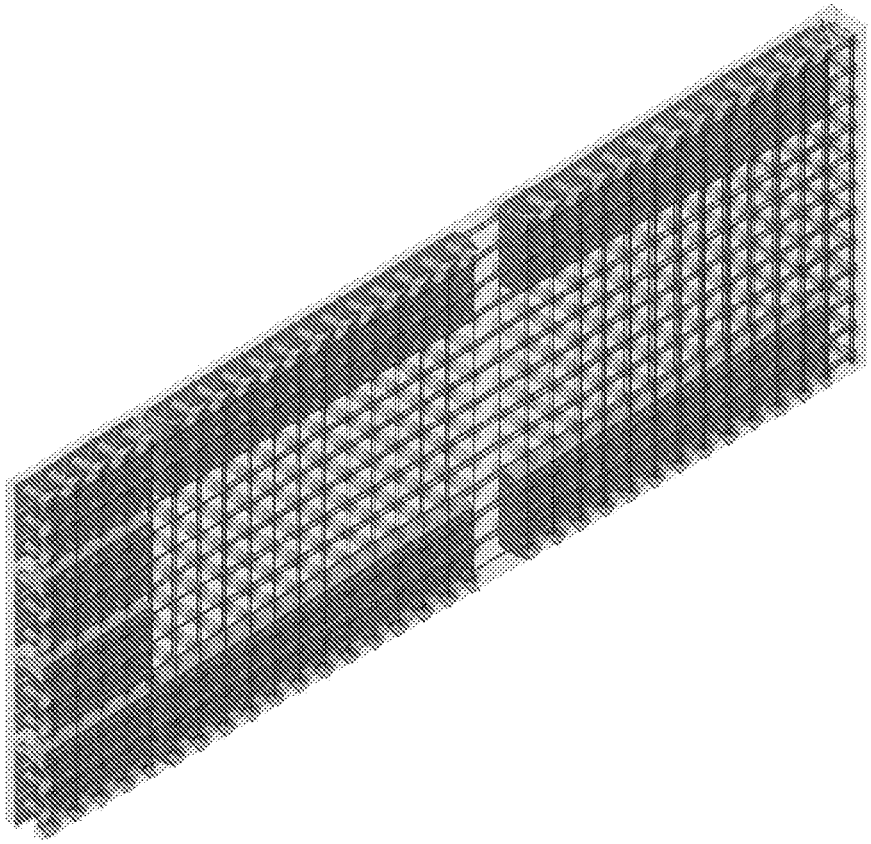
Figure 39:
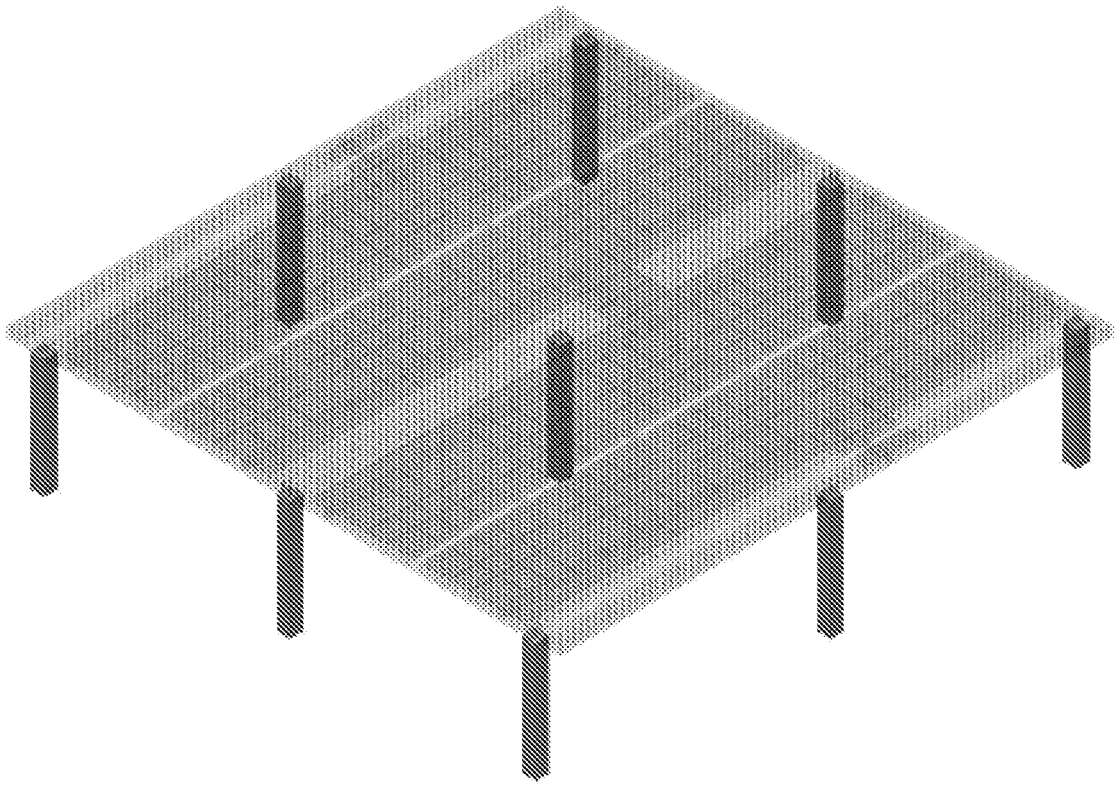
FIG. 39 shows a single floor construction and and FIG. 40 shows a multi-floor construction created using joined concrete elements according to embodiments of the invention.
Figure 40:
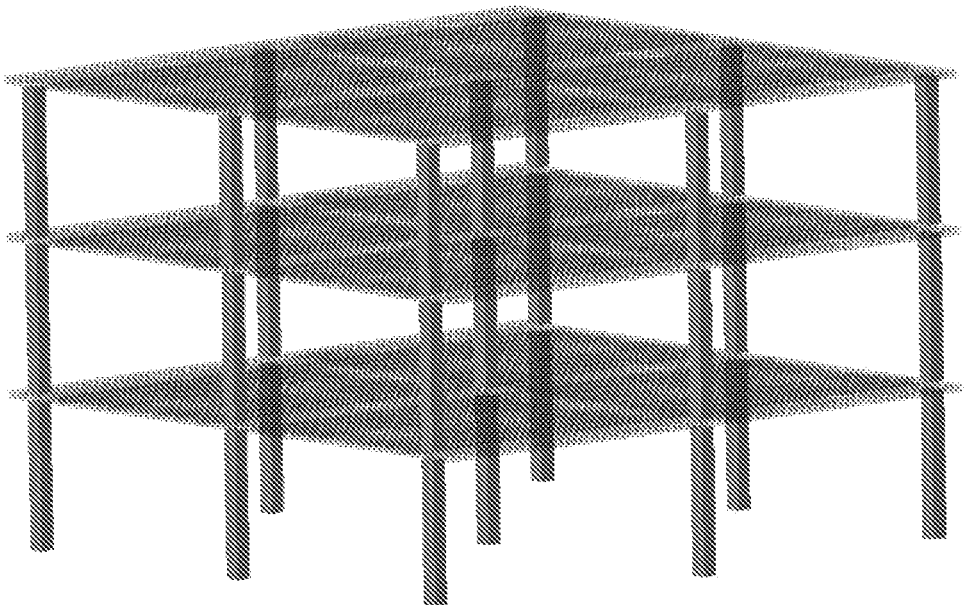

Precast concrete elements 18 as shown in FIG. 27 or 28 may be joined together to form a larger construction element, which can be used as a horizontal concrete floor element as shown in FIGS. 36 and 37, or a vertical concrete wall element as shown in FIG. 38. This may be in turn used to create a floor construction as exemplified in FIGS. 39 and 40.

In an alterative to pre-cast concrete construction techniques, void former units 1 may be used in situ to form larger construction elements by pouring concrete onsite. That is, the void former units 1 may be laid out onsite with concrete poured thereover to produce items such as: ground-bearing slabs, foundation pads, building cores, and pavements.

Where geometry does not match the modular grid precisely, it is intended that geometry differentials be established at the construction geometry perimeter (e.g. slab perimeter edges) using an edge shutter formwork method. Similarly, zones of the geometry can be remain free of the void former system to accommodate other non-grid dimensions and construction details such as; column connections, recesses, steps, penetrations, lifting fixings, façade fixings, service fixings, etc.

Figure 41:
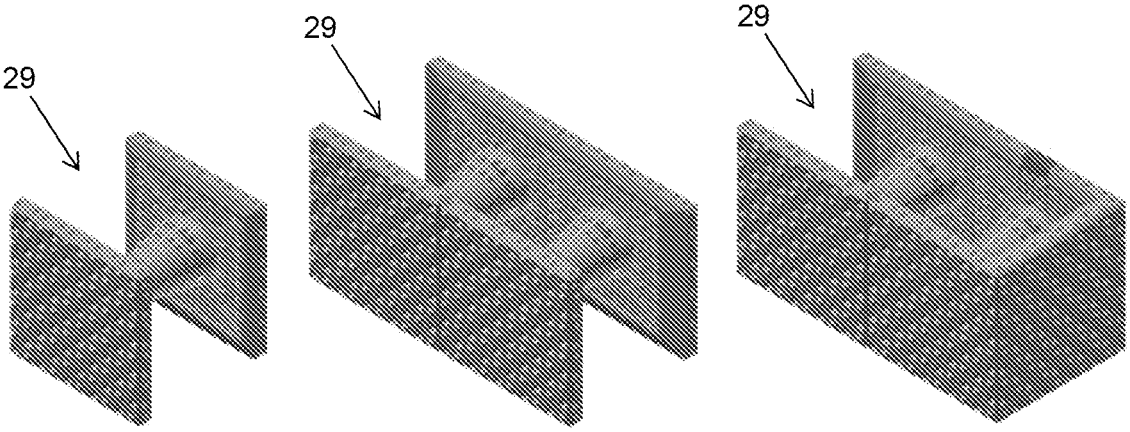
FIG. 41 shows blocks formed using void former units according to an embodiment of the invention.

Alternatively, cast concrete blocks 29 can be created using void former units 1 according to an embodiment of the invention exemplified in FIG. 41. The blocks 29 can be used much like standard bricks but provide for larger void spaces, allowing the blocks 29 to be lighter than standard bricks. Like standard bricks, the blocks can then be used to construct walls such as retaining walls. Compared to traditional bricks, the blocks are much lighter and use less concrete to produce. Traditional brick-laying methodologies may be modified to the lay the blocks in to a wall or similar. In an embodiment, concrete may be poured into the continuous void formed in a block wall laid using the blocks 29. Alternatively, the void space 9 can be filled with insulation via means such as injection of expanding foam or blown fibres.

Figure 42:
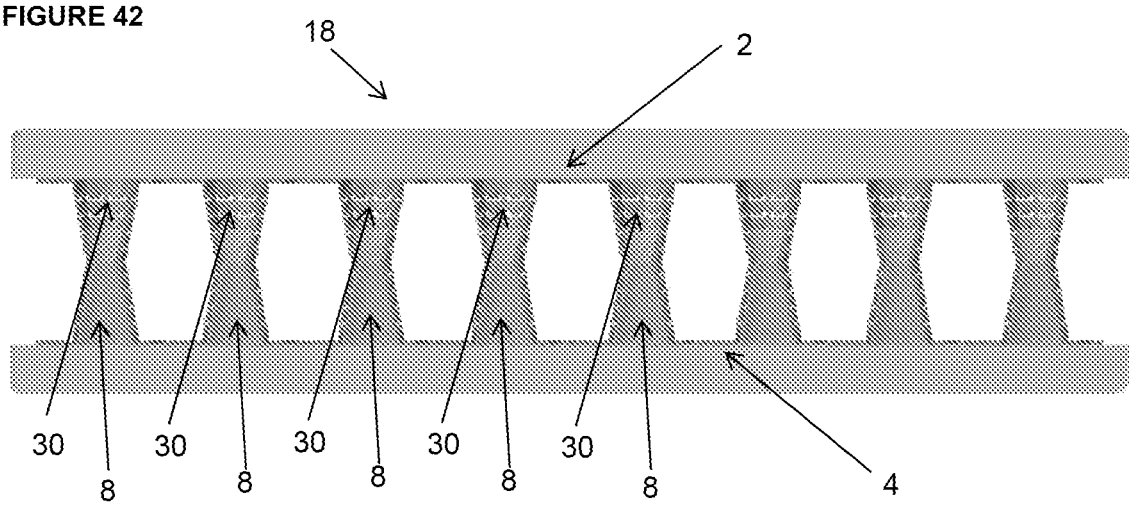
FIGS. 42 and 43 show concrete elements in which void former units incorporate a body of insulting material to improve sound and/or heat insulation from one side of the concrete element to the other.
Figure 43:
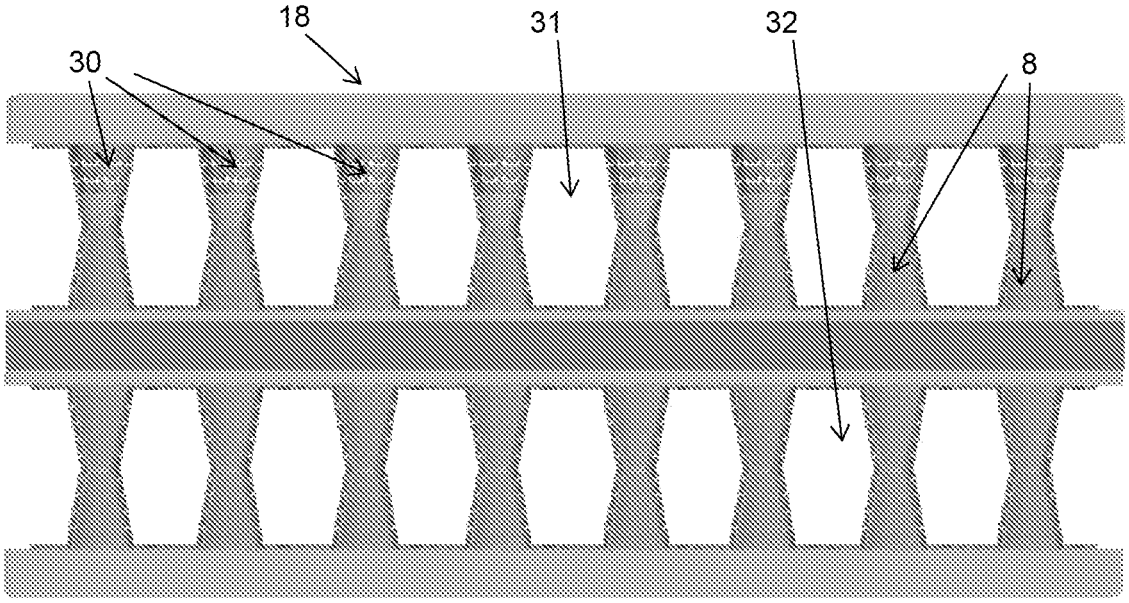

In another embodiment, a concrete element 18 can be produced with further improved insulative properties as exemplified by FIGS. 42 and 43. As such in FIGS. 42 and 43, passages 8 within void former units 1 may include a body of insulative material 30, such as polystyrene, which provides a thermal barrier within the passage 8 and between a first surface 4 and a second surface 6 of the void former unit 1. In use, the body of insulative material 30 joins to but otherwise substantially separates concrete formed on either side of the passage 8 and the void former unit 1. When used as part of a concrete element 18, bodies of insulative material 30 may be found in one, some or all passages 8 to improve insulative properties from one side of the concrete element 18 to the other (i.e. by reducing heat and/or sound flow through passages 8). In embodiments comprising a hollow spacer element 11, a body of insulative material 30 may be placed in the hollow spacer element 11 to thermally insulate one side of the hollow spacer element 11 from the other. Additionally, the void space 9 can be filled with insulation via means such as injection of expanding foam or blown fibres.

For construction elements that require voids to provide multiple functions, multiple layers of void space can be provided as shown in FIG. 43. For example, void space 31 can be left empty or filled with insulation, and void space 32 can be left empty of filled with concrete. In this way, a first layer of void former units 1 otherwise incorporating void space 31 may provide the greater insulative properties, while a second layer of void former units 1 otherwise incorporating void space 32 may provide the greater structural properties.

The construction elements including the void former elements can be used with other similar components or in combination with a wide range of other components such as; 'Hollowcore' planks, solid precast walls and columns, in situ concrete, steel beams, etc. The overall construction shall typically result in buildings and other civil engineering forms.

The void former elements, assemblies and systems can be used in configurations with or without the use of concrete. Other materials can be used, or indeed no other material may be required. The components can be used in a wide range of applications, such as for or forming part of: toys, temporary or permanent flooring/panels, acoustic panels, air-conditioning ventilation and/or fire suppression systems, gas/liquid barriers, water/liquid/gas storage/drainage systems, irrigation, horticulture applications (growing plants), signage panels, sculptures, roads, pavements, crawl space, animal/human passage/occupancy, and below/above ground water retention/aeration systems.

FIGS. 44 and 45 demonstrate the potential use of void former units 1 and void former systems 15 in horticultural applications. FIG. 44 shows a void former unit 1 in which the top surface 4 and/or the remainder of the first void former element 2 comprises apertures 10 allowing water and plant roots to pass through, while substantially preventing passage of soil 34. In this embodiment the void former unit 1 may otherwise be configured to retain water and operate as a water store as shown in FIG. 45. For example, the second void former element 3 may be configured without apertures and the first void former element 2 and the second void former element 3 and side-edge void former elements 16 may be connected in a manner with prevents leakage of water.

Although the present invention has been described with reference to preferred embodiments, workers skilled in the art will recognize that changes may be made in form and detail without departing from the spirit and scope of the invention.

The invention is claimed as follows:

1. A void former unit suitable for forming a void in a concrete element comprising:

(a) a first void former element, the first void former element comprising a first surface and at least one first opening in the first surface;

(b) a second void former element, the second void former element comprising a second surface opposite the first surface and at least one second opening in the second surface, each second opening corresponding to a first opening in the first surface, wherein the first void former element and the second void former element are connected to form a passage between each first opening and its corresponding second opening, and a void space surrounding the or each passage, and further wherein the void former unit is modular in shape to allow for multiple void former units to be connected together, thereby substantially continuously extending:

(c) the first surface;

(d) the second surface; and (e) the void space between the first surface and the second surface, across multiple void former units.

2. The void former unit of claim 1, wherein the first surface and the second surface are substantially flat.

3. The void former unit of claim 1, further comprising at least one side-edge void former element, wherein each side-edge void former element connects the first void former element to the second void former element along a peripheral edge of the void former unit to at least partially enclose the void space surrounding the or each passage.

4. The void former unit of claim 1, wherein the void former unit comprises a plurality of apertures to allow concrete to seep through during pouring and curing of concrete.

5. The void former unit of claim 1, wherein the first surface and/or the second surface comprise surface indents or ribs to reinforce the corresponding void former element, and/or enhance interface load transfer in a resulting concrete element.

6. The void former unit of claim 1, further comprising one or more sleeve or positioning elements to in use slidably house or position one or more joint reinforcement bar(s).

7. The void former unit of claim 1, wherein the first void former element is detachably connected to the second void former element.

8. The void former unit of claim 1, wherein the void former unit is formed of injection molded plastic.

9. The void former unit of claim 1, wherein the void former unit comprises a connection means to detachably connect the void former unit to other like void former units.

10. The void former unit of claim 9, wherein the connection means comprises an interlocking mechanism.

11. A void former system comprising a plurality of concrete void former units according to claim 1, wherein the concrete void former units are connected together to provide a substantially continuously extended: first surface; second surface, and void space extended between the extended first surface and the extended second surface, across multiple void former units.

12. A void former system according to claim 11, further comprising: at least one side-edge void former element, the at least one side-edge void former element connecting a first void former element to its corresponding second void former element along a periphery of the void former system to at least partially enclose the void space(s) of the void former system.

13. A void former system according to claim 12, wherein each of the plurality of void former units are detachably connected to one another.

14. A void former system comprising:

a plurality of void former units, each void former unit suitable for forming a void in a concrete element and each void former unit comprising:

a first void former element, the first void former element comprising a first surface and at least one first opening in the first surface; and a second void former element, the second void former element comprising a second surface opposite the first surface and at least one second opening in the second surface, each second opening corresponding to a first opening in the first surface, wherein the first void former element and the second void former element are connected to form a passage between each first opening and its corresponding second opening, and a void space surrounding the or each passage, and further wherein the void former unit is modular in shape to allow for multiple, void former units to be connected together, wherein the concrete void former units are connected together provide a substantially continuously extended: first surface; second surface, and void space extended between the extended first surface and the extended second surface, across multiple void former units, wherein each of the plurality of void former units are detachably connected to one another, and wherein the plurality of void former units are detachably connected by an interlocking mechanism.

15. A method of producing a concrete element, the method comprising:

(a) positioning a void former unit according to claim 1, in a mold to provide for a void in a cast concrete element;

(b) pouring concrete around the void former unit and within the passages formed between the first openings and the second openings, while preventing the concrete from entering the void space(s) surrounding the passages; and (c) allowing the concrete to cure.

16. The method of claim 15, further comprising positioning reinforcing materials in the mold and in the passage(s) so as to reinforce the resulting concrete element.

17. The method of claim 15, further comprising positioning the void former unit in the mold to form an accessible void space in the surface of the resulting concrete element.

18. The method of claim 17, further comprising slidably housing one or more joint reinforcement bar(s) at least partially in the accessible void space such that it may reinforce a joint formed between two like concrete elements.

19. The method of claim 15, the method further comprising:

(a) placing the concrete element in alignment with the like concrete element such that the accessible void of each concrete element is adjacent one another; and (b) pouring concrete into the adjacent accessible voids to provide a connection between the two concrete elements; and (c) allowing the poured concrete to set.

20. The method of claim 19, wherein the method further comprises slidably housing one or more joint reinforcement bar(s) into an adjacent void space of the like concrete element prior to pouring concrete into the adjacent void space.

* * * * *